US006256461B1

(12) United States Patent
Takeyama et al.

(10) Patent No.: US 6,256,461 B1
(45) Date of Patent: Jul. 3, 2001

(54) IMAGE FORMING APPARATUS WITH AN INTERMEDIATE TRANSFER BODY INCLUDING REFERENCE MARKERS FOR CONTROLLING THE SAME

(75) Inventors: Yoshinobu Takeyama; Nobuyuki Yanagawa, both of Kanagawa; Masanori Saito, Tokyo; Hideaki Kibune, Kanagawa; Tomoyoshi Takeuchi, Tottori; Masatoshi Tanaka, Tottori; Norio Kawamoto, Tottori, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/499,392

(22) Filed: Feb. 7, 2000

(30) Foreign Application Priority Data

| | | |
|---|---|---|
| Feb. 8, 1999 | (JP) | 11-029661 |
| Feb. 19, 1999 | (JP) | 11-041551 |
| Nov. 22, 1999 | (JP) | 11-330961 |

(51) Int. Cl.[7] ..... G03G 15/16
(52) U.S. Cl. ..... 399/66; 399/302; 399/308
(58) Field of Search ..... 399/66, 297, 298, 399/299, 301, 302, 308

(56) References Cited

U.S. PATENT DOCUMENTS

| | | | | |
|---|---|---|---|---|
| 4,615,607 | | 10/1986 | Yanagawa et al. | 399/231 |
| 5,337,136 | * | 8/1994 | Knapp et al. | 399/299 |
| 5,512,986 | * | 4/1996 | Toyomura et al. | 399/60 |
| 5,515,145 | * | 5/1996 | Sasaki et al. | 399/302 |

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

An image forming apparatus for transferring a toner image from an image carrier to a sheet-like recording medium by way of an intermediate transfer body is disclosed. A position on the intermediate transfer body where image formation should start is determined in accordance with the frequency of use of each of a plurality of regions defined on the intermediate transfer body. Specifically, one of the regions minimizing the sum of the frequencies of use of the regions is selected as the above position. The intermediate transfer body can therefore be evenly used over its entire circumference. While the intermediate transfer body is in a stand-by state, it is intermittently driven so as to be free from deformation.

48 Claims, 16 Drawing Sheets

IMAGE FORMING APPARATUS WITH AN INTERMEDIATE TRANSFER BODY INCLUDING REFERENCE MARKERS FOR CONTROLLING THE SAME

BACKGROUND OF THE INVENTION

The present invention relates to an image forming apparatus of the type transferring a toner image from an image carrier to a sheet-like recording medium by way of an intermediate transfer body.

An electrophotographic image forming apparatus of the type transferring a toner image from a photoconductive drum to a paper or similar sheet-like recording medium by way of an intermediate transfer belt is conventional. It is a common practice with this type of apparatus to set various image forming conditions on the basis of a reference mark or marks provided on the belt. Japanese Patent Laid-Open Publication No. 7-36249, for example, teaches a color image forming apparatus capable of causing an intermediate transfer belt to run at a constant speed by sensing a plurality of marks provided on the belt. Japanese Patent Laid-Open Publication No. 7-325455 discloses a color image forming apparatus in which a reference mark is formed on a photoconductive belt and then transferred to an intermediate transfer belt for the purpose of accurately matching the image areas of the two belts.

Further, Japanese Patent Laid-Open Publication No. 8-101554 proposes a multicolor image forming apparatus including a plurality of sensing means provided on an intermediate transfer belt for sensing changes ion dimension ascribable to temperature or humidity. Moreover, Japanese Patent Laid-Open Publication No. 10-104970 discloses a color image forming apparatus in which a bias is not applied at a reference mark position in order to form an attractive image.

In an image forming process effected with an intermediate transfer belt provided with a single mark (marker hereinafter) as a reference for the start of image formation, every time the belt makes one turn, a single image forming period exists on the belt, and an image transferring period occurs slightly later than the image forming period. This brings about a problem that whatever the image size may be, the printing speed is fixed. Further, when marker sensing means senses the marker of the belt, image formation on a photoconductive drum including in image forming means starts on the elapse of a preselected period of time. Subsequently, as soon as the leading edge of an image on the drum reaches a preselected position in a preselected period of time, the image is transferred from the drum to the belt. In this case, even in a repeat print mode, the next image is not formed until the marker passes the marker sensing means. As a result, the image forming means remains in a stand-by state between the transfer of an image to the belt and the next image forming operation.

Assume that a single marker is provided on the intermediate transfer belt. Then, whenever the apparatus is in a stand-by state, the belt with the single marker remains stationary at the same position. Therefore, in the case where the belt is passed over rollers, the belt is apt to deform. Moreover, because image transfer starts at the same position at all times, deterioration and therefore wear is likely to concentrate at a particular portion of the belt.

Furthermore, to form a color image, the interval between the sensing of the marker and the start of the next image formation must be set beforehand by taking account of a period of time necessary for, e.g., the switching of a developing color. This cannot be done without resorting to a large counter capable of counting a long period of time with accuracy. In addition, irregularities in the movement of the belt accumulate between the sensing of the marker and the start of the next image formation, preventing toner images of different colors from being transferred in accurate register with each other.

SUMMARY OF THE INVENTION

It is therefore an object of the present invention to provide an image forming apparatus capable of protecting an intermediate transfer belt from local deterioration.

It is another object of the present invention to provide an image forming apparatus capable of protecting an intermediate transfer body from early wear.

It is still another object of the present invention to provide an image forming apparatus promoting the efficient use of an intermediate transfer body.

It is yet another object of the present invention to provide an image forming apparatus capable of reducing an image forming time.

It is a further object of the present invention to provide an image forming apparatus capable of efficiently printing an image in accordance with the image size, protecting an intermediate transfer body local deformation, and obviating early deterioration ascribable to such deformation.

In accordance with the present invention, an image forming apparatus includes an image forming section for forming a toner image on an image carrier. The toner image is transferred from the image carrier to an intermediate transfer body. A transferring device transfers the toner image from the intermediate transfer body to a sheet-like recording medium. A storage stores the frequency of use of each of a plurality of regions of the intermediate transfer body. A selector selects, in accordance with the frequencies of use stored in the storage, a transfer start position on the intermediate transfer body where the transfer of the toner image to the intermediate transfer body should start.

Also, in accordance with the present invention, an image forming apparatus includes a plurality of image forming sections. Each image forming section includes a respective image carrier for forming a toner image thereon, a respective optical writing device for optically writing a latent image on the image carrier, at least two developing devices each for developing the latent image with toner of particular color, and a switching device for selecting one of the two developing devices. The toner image is transferred to an intermediate image transfer body. A transferring device transfers a composite toner image from the intermediate transfer body to a sheet-like recording medium. A storage stores the frequency of use of each of a plurality of regions of the intermediate transfer body. A selector selects, in accordance with the frequencies of use stored in the storage, a transfer start position where the transfer of the toner image to the intermediate transfer body should start.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, brief reference will be made to an image forming process available with a conventional image forming apparatus of the type including an intermediate transfer belt provided with a single marker, shown in FIG. 1. As shown, while the belt makes one turn, a single image forming period exists on the belt, and an image transferring period occurs slightly later than the image forming period. This brings about a problem that whatever the image size may be, the printing speed is fixed.

Figure 2:
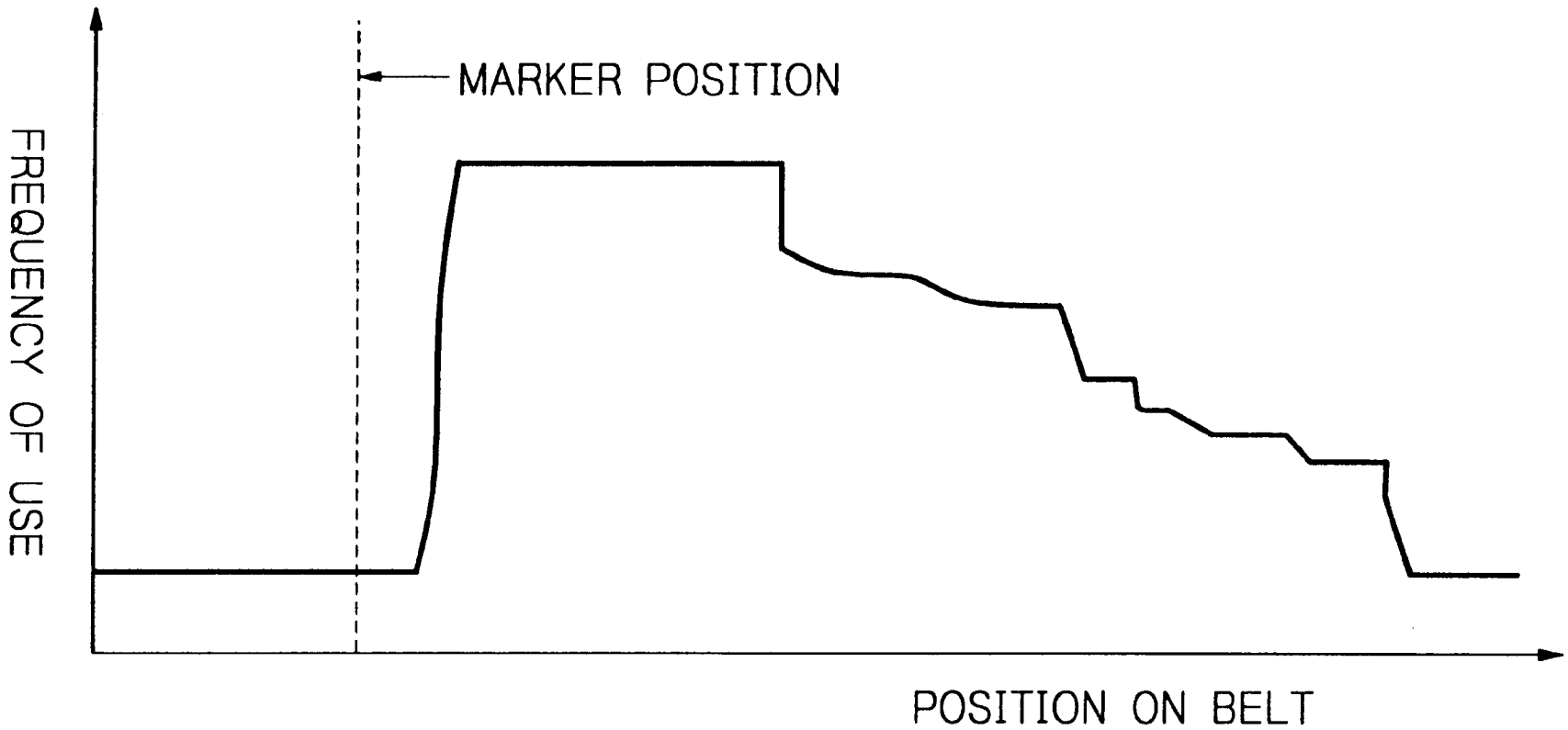
Fig. 2 PRIOR ART
FIG. 2 is a graph showing a relation between the position on an intermediate transfer belt and the frequency of use of the belt particular to the apparatus shown in FIG. 1.

Further, whenever the apparatus is in a stand-by state, the belt with the single marker remains stationary at the same position. Therefore, in the case where the belt is passed over rollers, the belt is apt to deform. Moreover, because image transfer begins at the same position at all times, deterioration is likely to concentrate at a particular portion of the belt. Specifically, FIG. 2 shows a relation between the position on the belt (abscissa) and the frequency of use of the belt (ordinate). As shown, the portion of the belt adjoining the marker is used more often than the other portion, resulting in local wear.

Preferred embodiments of the image forming apparatus in accordance with the present invention will be described hereinafter. It is to be noted that the illustrate embodiments are practicable with an intermediate transfer drum in the same manner as with an intermediate transfer belt. In this sense, the intermediate transfer belt, intermediate transfer drum and other intermediate transfer media will be generally referred to as an intermediate transfer body. Further, an image carrier included in the illustrative embodiment may be implemented as a magnetic drum in place of a photoconductive drum, in which case optical writing means will be replaced with magnetic writing means.

Figure 3:
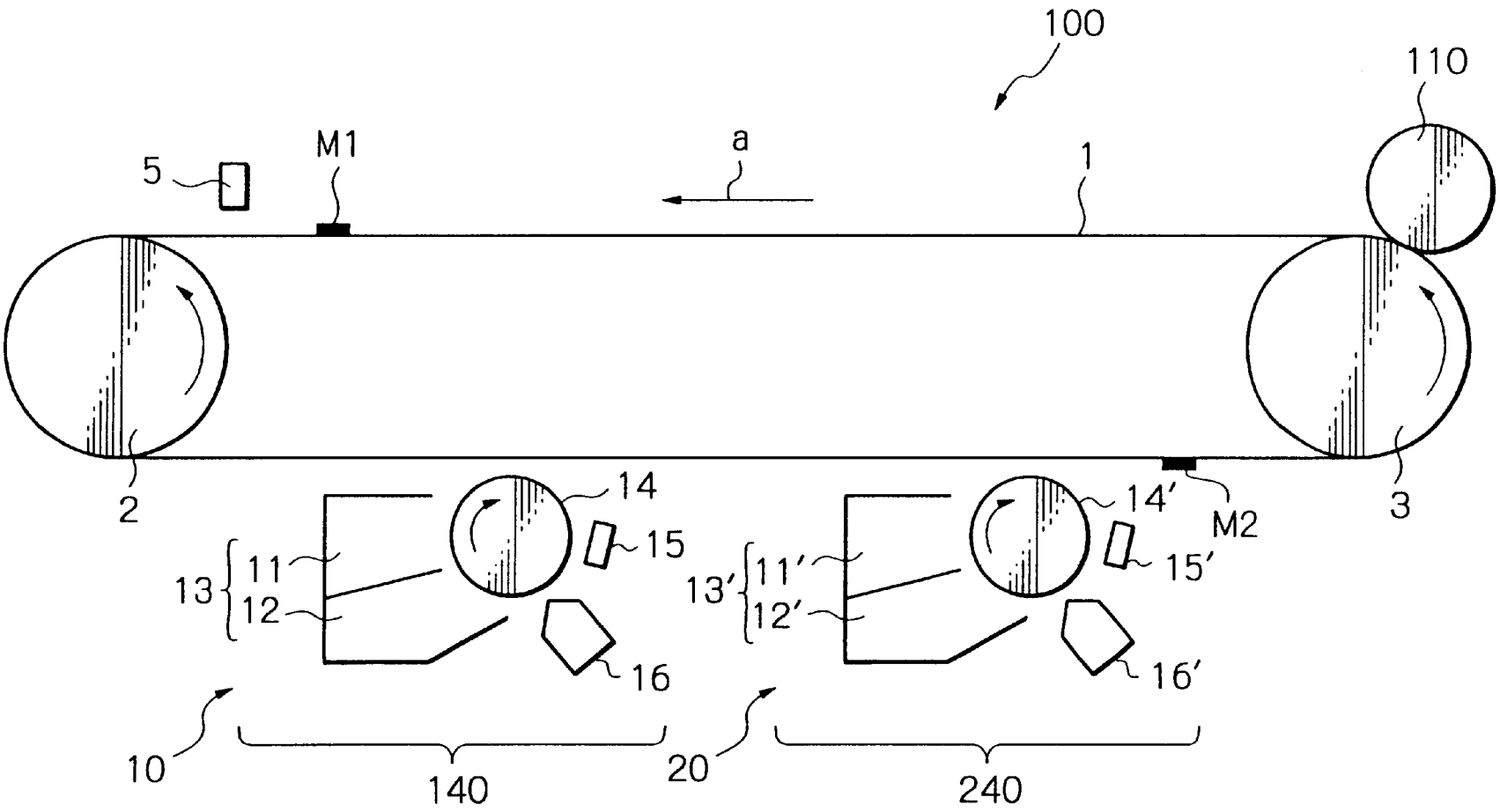
FIG. 3 is a fragmentary view showing an image forming apparatus in accordance with the present invention.

Reference will be made to FIGS. 3 through 6 for describing the construction and operation of an image forming apparatus to which the present invention is applied. The image forming apparatus is implemented as a color image forming apparatus by way of example. As shown in FIG. 3, the color image forming apparatus, generally 100, includes two photoconductive drums 14 and 14'. A first image station 140 includes charging means 15, writing means 16, developing means 13, cleaning means, not shown, and other image forming means arranged around the drum 14. Likewise, a second image station 240 includes charging means 15', writing means 16', developing means 13', cleaning means, not shown, and other image forming means arranged around the other drum 14'. The first and second image stations 140 and 240 are arranged along a single run of an intermediate transfer belt 1 at a preselected distance from each other.

At each of the image stations 140 and 240, an image forming process is executed in accordance with the conventional electrostatic recording system. Specifically, the charging means uniformly charges the surface of the photoconductive drum in the dark. The writing means electrostatically writes a latent image of a given color on the charged surface of the photoconductive drum. The developing means develops the latent image with toner to thereby form a corresponding toner image. The toner image is transferred from the drum to the intermediate transfer belt.

Assume that the developing means at each image station stores toner of two different colors. Then, if two of four colors, i.e., three primary colors and black are allocated to each developing means, a full-color image is obtainable.

In the above configuration, while the same image forming area of the intermediate transfer belt sequentially moves via the two image stations, each image station transfers a toner image of one color to the belt in register with the other toner image. Subsequently, while the above image forming area carrying the resulting two-color toner image is again moved via the consecutive image stations, each image station transfers a toner image of the other color to the belt over the two-color toner image. As a result, a full-color toner image is completed on the belt while the same image forming area of the belt passes the two image stations twice. The full-color toner image is transferred from the belt to a paper or similar recording medium and then fixed by fixing means.

The above apparatus implements high-speed printing in synchronism with the rotation of the intermediate transfer belt and is shown as using a photoconductive drum as an image carrier and a combination of LEDs (Light Emitting Diodes) and a converging light transmitting body. If desired, the image carrier may be implemented by a seamless belt while the writing means may be implemented by a laser. Further, for the image carrier, use may be made of a medium capable of forming a latent image with means other than light or writing means capable of effecting such an image carrier with means other than light, i.e., electrically and magnetically.

As stated above, toner images of at least three primary colors A, B and C are transferred to the intermediate transfer belt one above the other, and the resulting full-color toner image is transferred form the belt to a paper or similar sheet-like recording medium. As shown in FIG. 3, first image forming means 10 and second image forming means 20 each including the photoconductive drum, charging means and developing means are arranged a long the same run of the belt 1 movable in a direction indicated by an arrow. The first and second image forming means 10 and 20 each transfer respective toner images to the belt 1 in order to complete a full-color image on the belt 1. The image forming means 10 and 20 are located at the first and second image stations 140 and 240, respectively.

Assume that the belt 1 has a circumferential length L, and that a paper has a length m as measured in the direction in which it is conveyed during image transfer. A color image forming process to be described hereinafter assumes $L=m+\alpha$. It is to noted that $\alpha$ is the length of the non-image area of the belt 1 as measured in the direction of movement of the belt 1 and is smaller than m. The length $\alpha$ depends on the length of the image area of the belt 1 or the length of the paper used and may therefore be greater than m when the paper has a particular length.

First, the first image station 140 including A-color developing means transfers an A-color toner image to the belt 1. The second image station 240 transfers a B-color toner image to the belt 1 over the A-color toner image to thereby form an AB-color toner image. Subsequently, the first image station 140 transfers a C-color toner image to the belt 1 over the AB-color toner image for thereby forming an ABC-color toner image. At this time, substantially one rotation of the belt 1 ends.

The second image station 240 transfers a D-color or black toner image to the belt 1 over the above ABC-color image, completing a full-color image on the belt 1. The full-color image is transferred to a paper by a transfer roller or transferring means 110. This occurs when the belt 1 is in the second rotation.

When a plurality of color prints are desired, the first image station 140 transfers a second A-color toner image to the belt 1 at the same time as the second image station 240 transfers the above D-color toner image to the belt 1. The second image station 240 then transfers a second B-color toner image to the belt 1 and thereby forms a second AB-color toner image. Subsequently, the first and second image stations 140 and 240 respectively transfer a second C-color toner image and a second D-color toner image, completing a second full-color image. The second full-color image is transferred to the second paper. This occurs when the belt 1 is in the fourth rotation.

The above procedure is repeated with the third paper and consecutive papers. Specifically, the third print is output when the belt 1 is in the sixth rotation.

In the apparatus 100 shown in FIG. 3, the belt or intermediate transfer body 1 is implemented by a seamless belt passed over a drive roller 2 and a driven roller 3. The drive roller 2 causes the belt 1 to move in the direction a. A plurality of markers defining reference positions on the belt 1 are provided on the outer surface of the belt 1 in an array. More specifically, the markers are positioned at one edge of the belt 1 in the widthwise direction perpendicular to the direction a and spaced from each other in the direction a.

One marker or two or more markers may be provided on the belt 1, as will be described hereinafter. Each marker resembles a line and reflects light more than the other portion of the belt 1.

Figure 4:
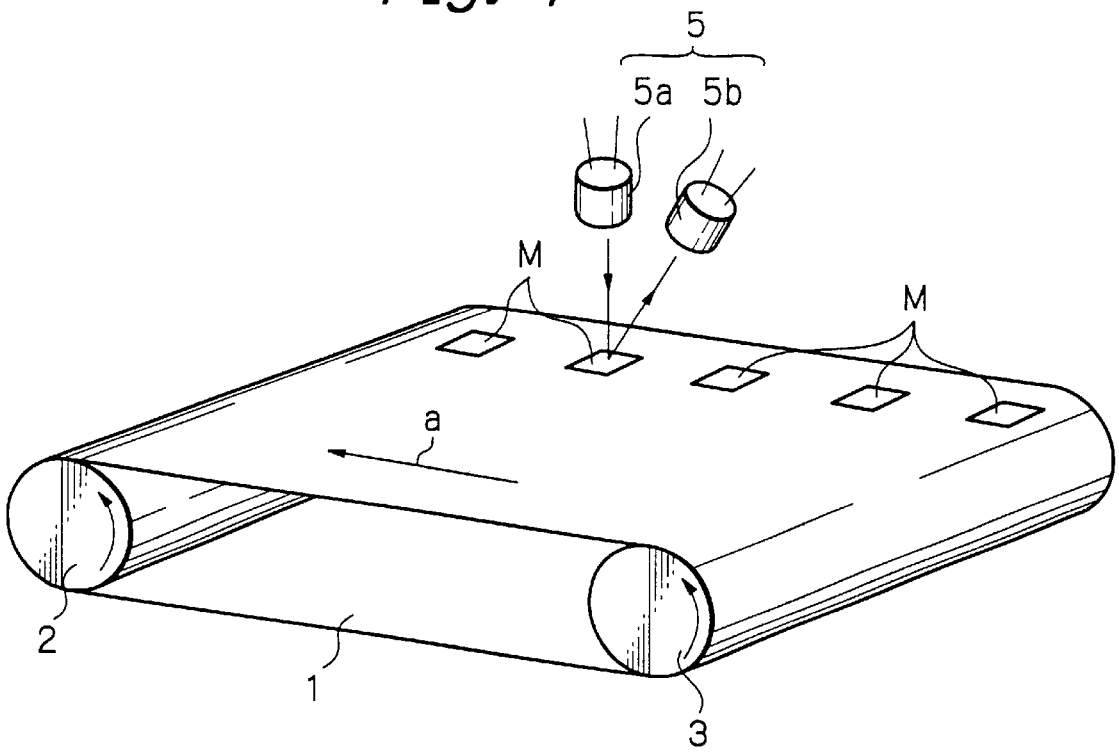
FIG. 4 is an isometric view showing an arrangement around an intermediate transfer belt included in the apparatus of FIG. 3.

In the above specific configuration, two markers M1 and M2 are formed on the belt 1, as shown in FIG. 3, or a number of markers M are formed on the same at preselected intervals, as shown in FIG. 4. In any case, sensing means 5 is positioned above the zone of movement of the markers and affixed to a stationary member not shown. The sensing means 5 is made up of a light emitting element 5*a* and a photosensitive element 5*b*.

Figure 5:
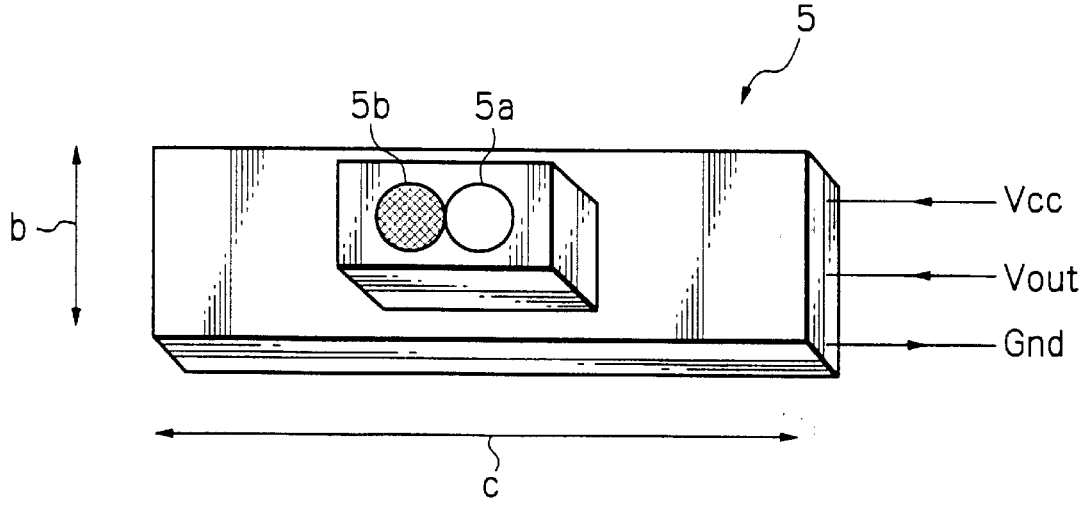
FIG. 5 is an isometric view showing sensing means included in the apparatus of FIG. 3.

As shown in FIG. 5, the light emitting element 5*a* of the sensing means 5 is implemented by, e.g., an LED while the photosensitive element 5*b* is implemented by e.g., a photosensor or phototransistor. The sensing means 5 has a vertical dimension b of about 10 mm and a horizontal dimension c of about 43 mm. When light issuing from the light emitting element 5*a* is reflected by the markers M1 and M2 or the markers M moving together with the belt 1, the reflection is incident to the photosensitive element 5*b* and allows control means, not shown, to detect the markers. Circuitry shown in FIG. 6 and control means 6 shown in FIG. 13 execute control relating to the markers M1 and M2 or the markers M.

Figure 6:
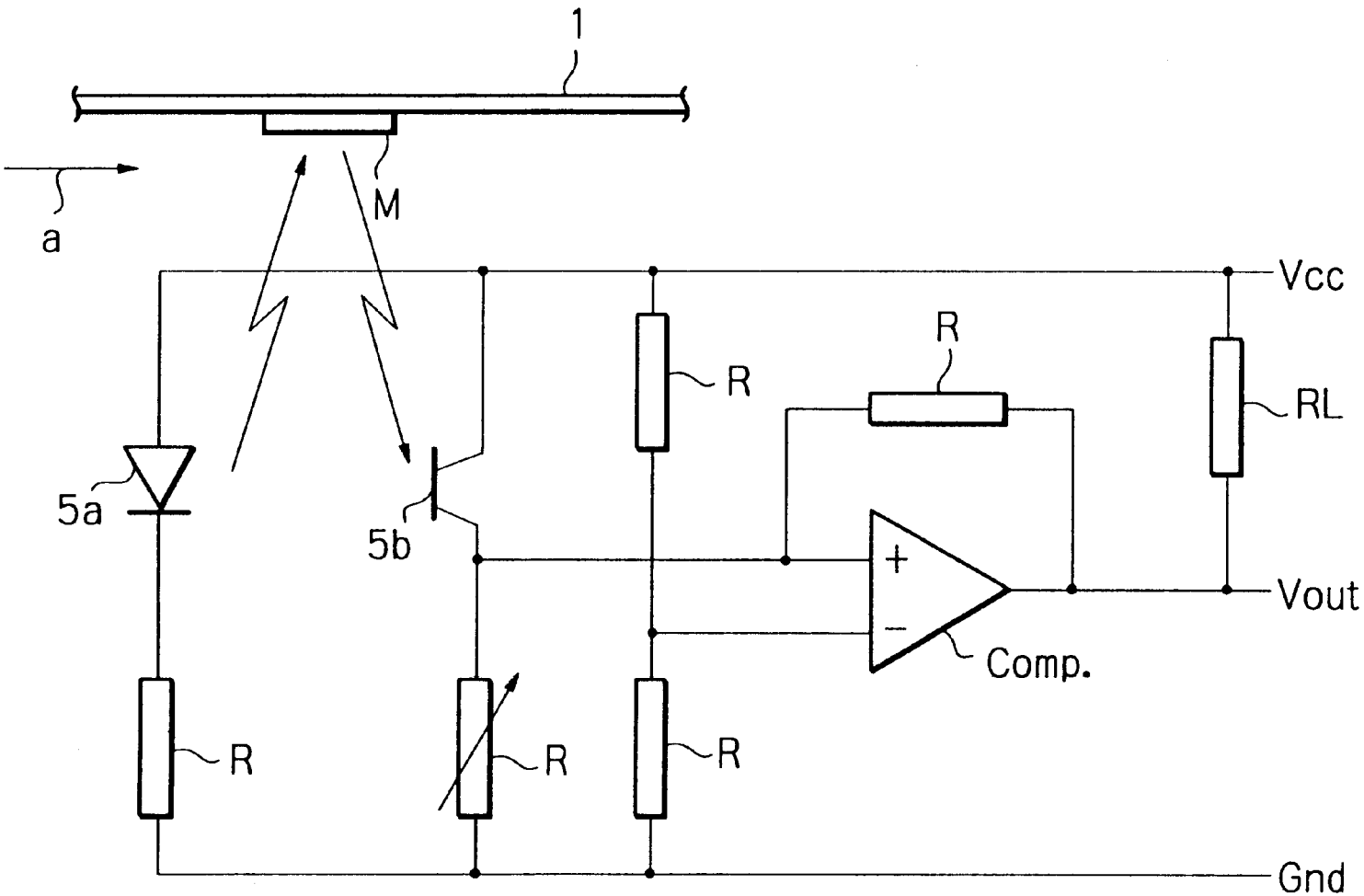
FIG. 6 is a circuit diagram showing marker sensing circuitry associated with the sensing means.

Specifically, the circuitry shown in FIG. 6 picks up marker signals output from the sensing means 5 and includes resistors R and RL and a comparator Comp. The circuitry has three terminals, i.e., a terminal connected to ground Gnd, a terminal to which an input voltage Vcc is applied, and a terminal via which an output voltage Vout is sent to control means 6, FIG. 13.

In FIG. 6, light issuing from the light emitting element 5*a* illuminates the belt 1. When the light is illuminating the portions of the belt 1 where the markers, collectively M, are absent, the photosensitive element 5*b* remains in an OFF state, and the output voltage Vout remains in a low (L) level. When any one of the markers M arrives at the sensing means 5, the resulting reflection from the marker M is incident to the photosensitive element 5*b* and causes the output voltage Vout to go high (H). The circuitry of FIG. 6 picks up the change of the output voltage Vout representative of the present of the marker M.

Should any toner be left on the non-reflective area of the belt 1 where the markers M are absent, it would also reflect the light issuing from the light emitting element 5*a* and would bring about detection errors. In light of this, the input voltage Vcc is driven by pulses, so that the output voltages Vout are detected in synchronism with the pulses.

Referring again to FIG. 3, the first and second image forming means 10 and 20 are identical in construction and form toner images with an electrophotographic system. In the first image forming means 10, the charging means 15 charges the photoconductive drum 14. The writing means 16 writes a latent image on the drum 14. The developing means 13 develops a latent image with toner. The cleaning means, not shown, cleans the drum 14 after image transfer. The developing means 13 includes two developing sections 11 and 12 assigned to the C-color and A-color, respectively. The developing sections 11 and 12 are selectively operated by switching means not shown. The above various means are sequentially arranged around the drum 14 in the order named in the direction of rotation of the drum 14 indicated by an arrow in FIG. 3.

Likewise, in the second image forming means 20, the charging means 14' charges the photoconductive drum 14'. The writing means 16' writes a latent image on the drum 14'. The developing means 13' develops a latent image with toner. The cleaning means, not shown, cleans the drum 14' after image transfer. The developing means 13' includes two developing sections 11' and 12' assigned to the B-color and D-color, respectively. The developing sections 11' and 12' are selectively operated by switching means not shown. The above various means are sequentially arranged around the drum 14' in the order named in the direction of rotation of the drum 14' indicated by an arrow in FIG. 3. The A, B, C and D colors are cyan, magenta, yellow and black, respectively.

In a full-color mode, the first and second image forming means 10 and 20 form toner images on the belt 1 in a sequence that will be described later. The resulting full-color image is transferred from the belt to a paper by transferring means.

The drums 14 and 14' each are rotated in synchronism with the movement of the belt 1 at a peripheral speed equal to the moving speed of the belt 1. The drums 14 and 14' are usually slightly spaced from the belt 1 and brought into contact with the belt 1 when toner images should be transferred therefrom to the belt 1. A transfer unit (see FIGS. 17 and 18) transfer the full-color image from the belt 1 to a paper.

Figure 13:
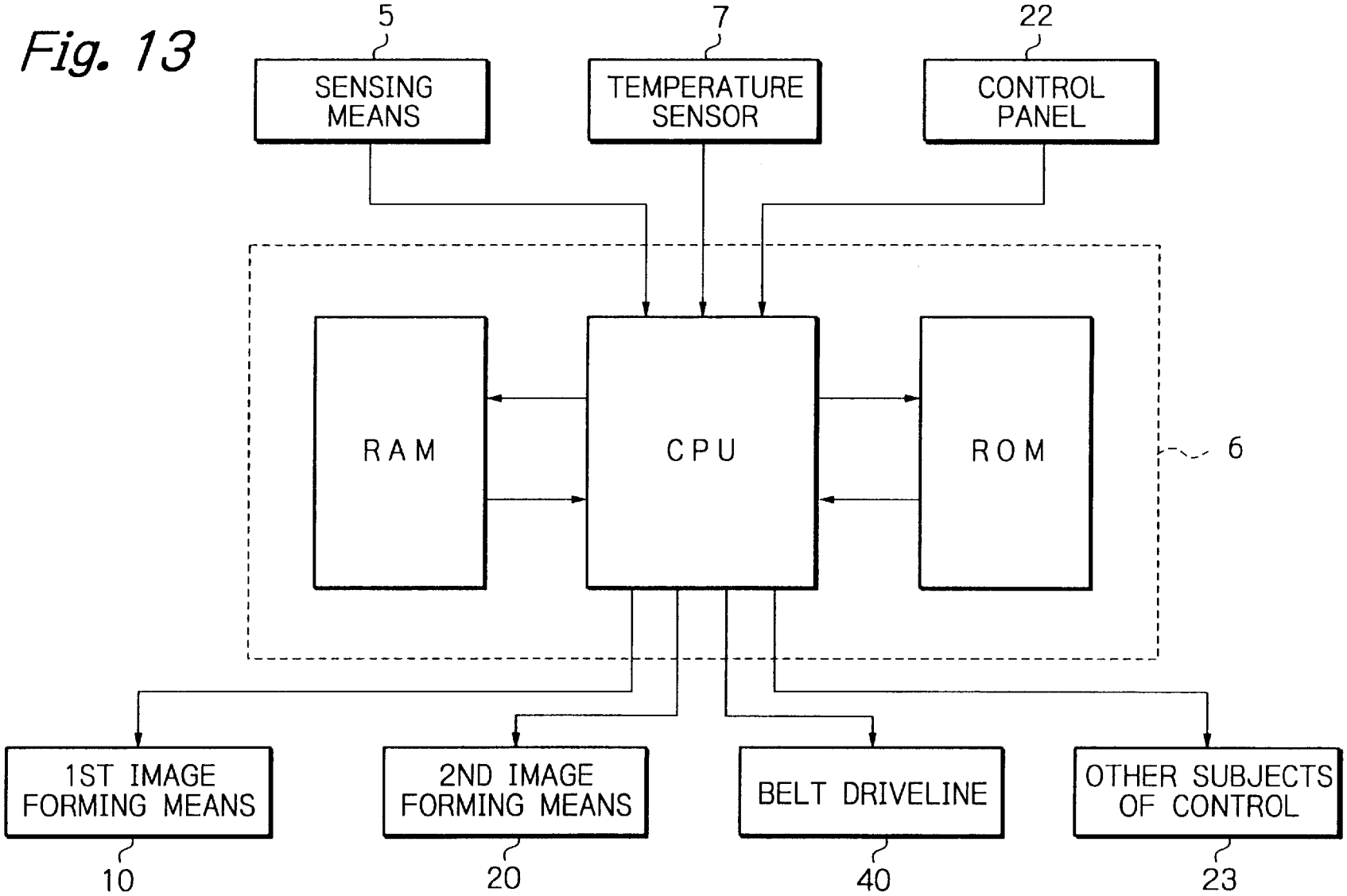
FIG. 13 is a block diagram schematically showing a control system included in the apparatus of FIG. 3.

FIG. 13 shows a control system for controlling the apparatus 100 including the first and second image forming means 10 and 20. The control means 6 of the control system includes CPU (Central Processing Unit), a RAM (Random Access Memory) and a ROM (Read Only Memory). Connected to the control means 6 are a control panel 22, the sensing means 5 and a temperature sensor 7. The control panel 22 includes switches to be operated for inputting desired image forming conditions.

The control means 6 sends control information necessary for image formation to the image forming means 10 and 20 and other subjects of control 23. In the case where the image forming apparatus is of the type including a single image forming means storing toner of one color, image forming means including black developing means will be substituted for the two image forming means 10 and 20. Also, when the belt 1 is replaced with an intermediate image transfer drum, a belt driveline 40 will be replaced with a drum driveline.

1st Embodiment

A first embodiment of the present invention will be described hereinafter on the assumption that a single marker M1 is provided on the intermediate transfer belt 1. When the control means 6, FIG. 13, receives a print start command from a host computer, not shown, it causes the drums 14 and 14' and belt 1 to move. In FIG. 3, when the belt 1 moves, the sensing means 5 senses the marker M1 and outputs a marker signal. The apparatus 100 starts performing an image forming operation in response to a marker signal detected for the first time after the belt 1 has reached a preselected speed. Whether or not the belt 1 has reached the preselected speed is determined on the basis of a period of time necessary for the belt 1 to reach the preselected speed set beforehand and by counting the drive time of the belt 1.

An image forming process particular to the illustrative embodiment will be described with reference to FIG. 7. For the simplicity of description, let the circumferential length of the belt 1 be divided into four regions 1 through 4. In the illustrative embodiment, a nonvolatile memory or storing means, not shown, stores a particular frequency of use of the belt 1 for each of the four regions 1 through 4, as shown in FIG. 8 specifically.

In response to the print start command, the control means 6 reads the region-by-region frequencies of use stored in the nonvolatile memory and determines a timing for starting image formation. In the illustrative embodiment, the control means 6 generates a timing after the detection of the marker M1 in such a manner as to use the regions 3 and 4. It follows that the formation of an image on the drum 14' and the transfer of the image from the drum 14' to the belt 1 are shifted accordingly.

Figure 1:
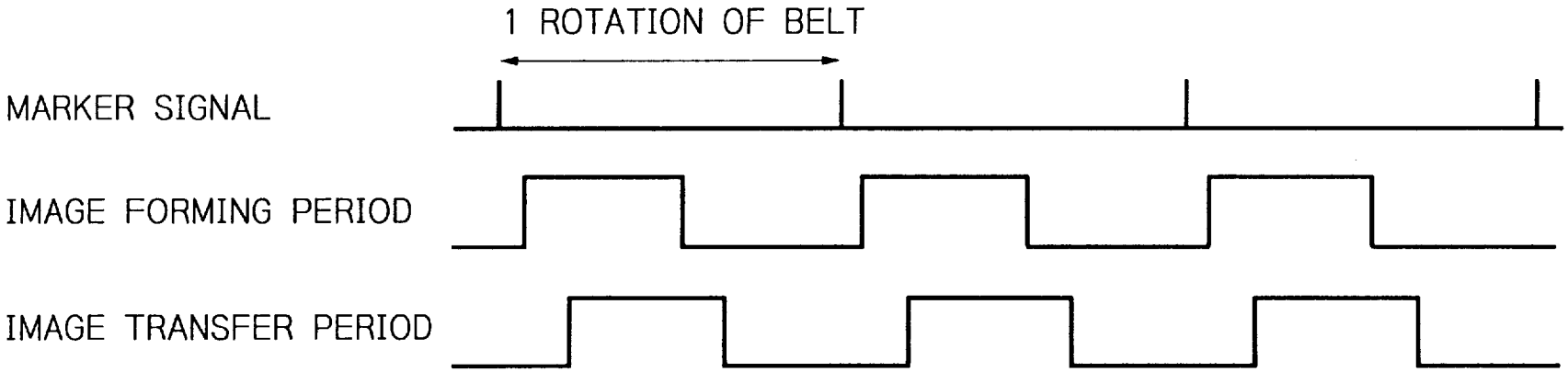
Fig. 1 PRIOR ART
FIG. 1 is a timing chart demonstrating the operation of a conventional image forming apparatus.
Figure 7:
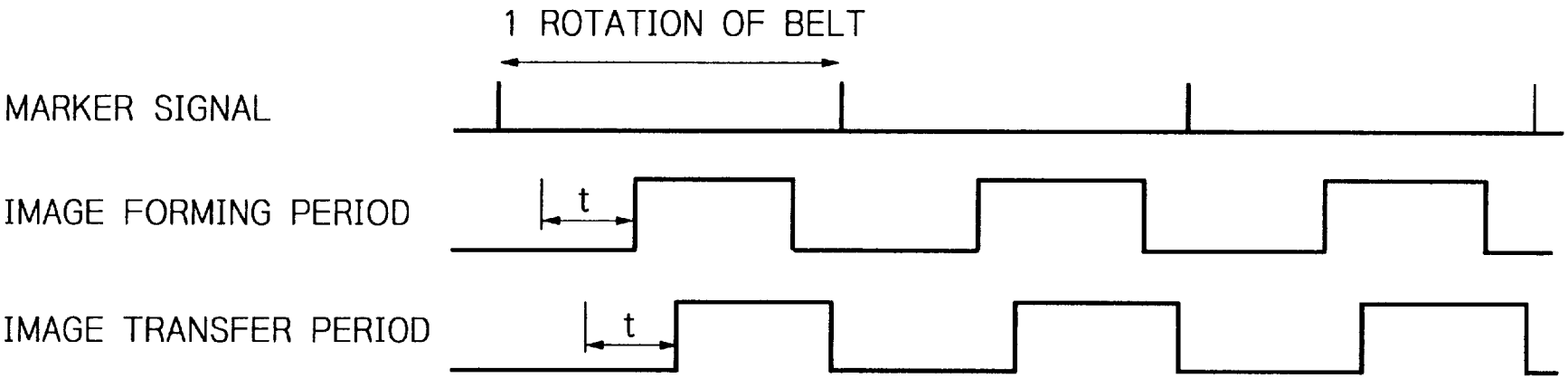
FIG. 7 is a timing chart representative of the operation of the apparatus of FIG. 3.
Figure 8:
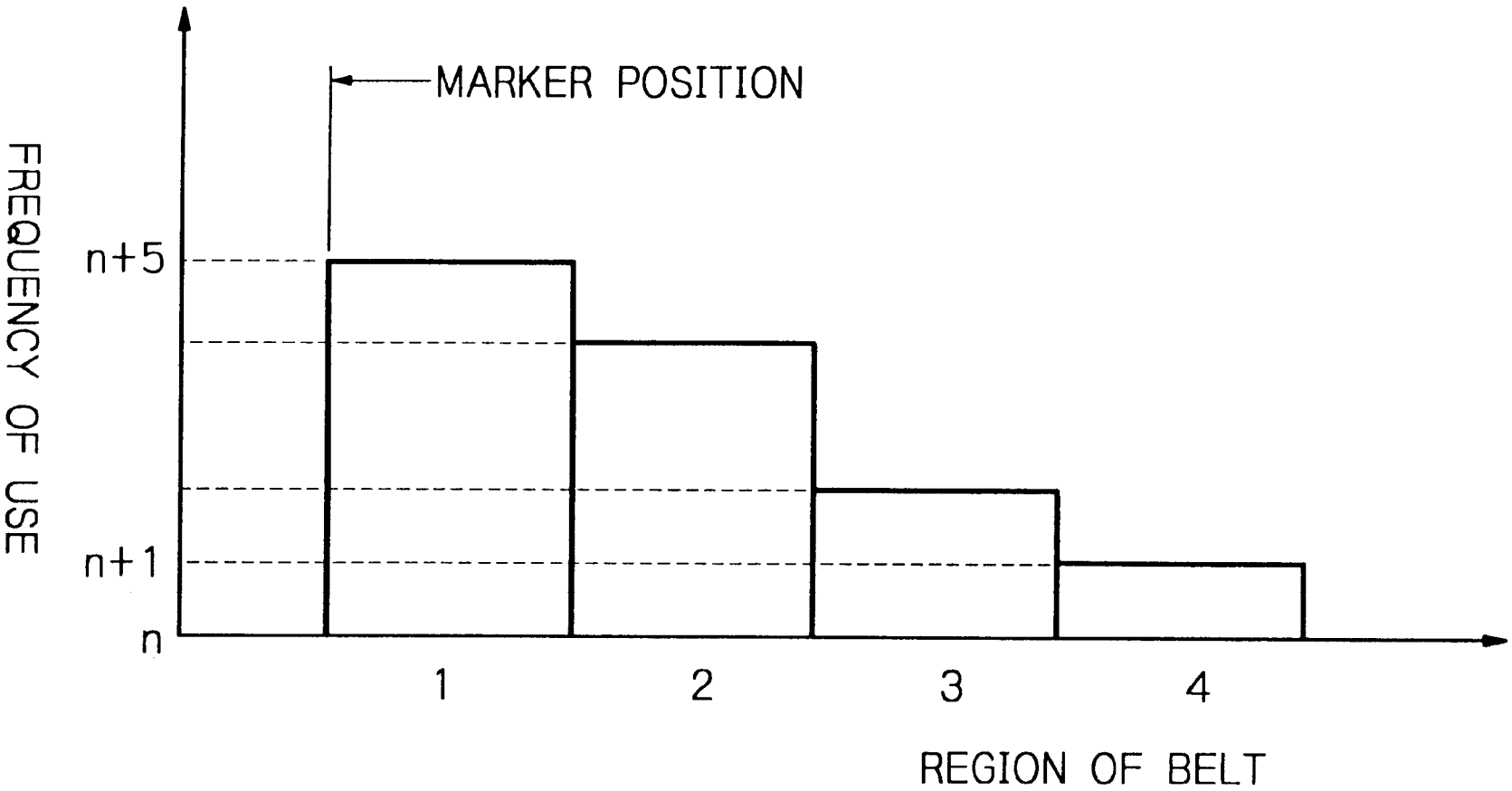
FIGS. 8, 9 and 10 are graphs showing a relation between a position on the intermediate transfer belt and the frequency of use of the belt unique to the apparatus of FIG. 3.

Specifically, as shown in FIG. 7, the image forming period and image transferring period each are shifted by a period of time $t_1$ compared to the conventional periods shown in FIG. 1. That is, the control means 6 varies the timing for starting image formation in accordance with the condition of use of the belt 1 and selects a particular position on the belt 1 to which a toner image is to be transferred from the drum 14' (selecting means).

The above storing means and selecting means allow the belt 1 to be evenly used over its entire length and thereby protects it from local wear. This is successful to obviate the deterioration of the belt 1 at an early stage.

When a full-color image is desired, it is necessary to use the two image forming means 10 and 20 and to cause the belt 1 to make two rotations. In such a case or in a repeat print mode, the operation with the shifted timing shown in FIG. 7 is continued until the end of printing.

The regions 1 through 4 of the belt 1 each have a length substantially equal to the shortest image transfer unit while the belt 1 has a circumferential length that is an integral multiple of the shortest image transfer unit. This promotes the efficient use of the belt 1 and reduces the capacity required of the nonvolatile memory of the control means 6.

Figure 9:
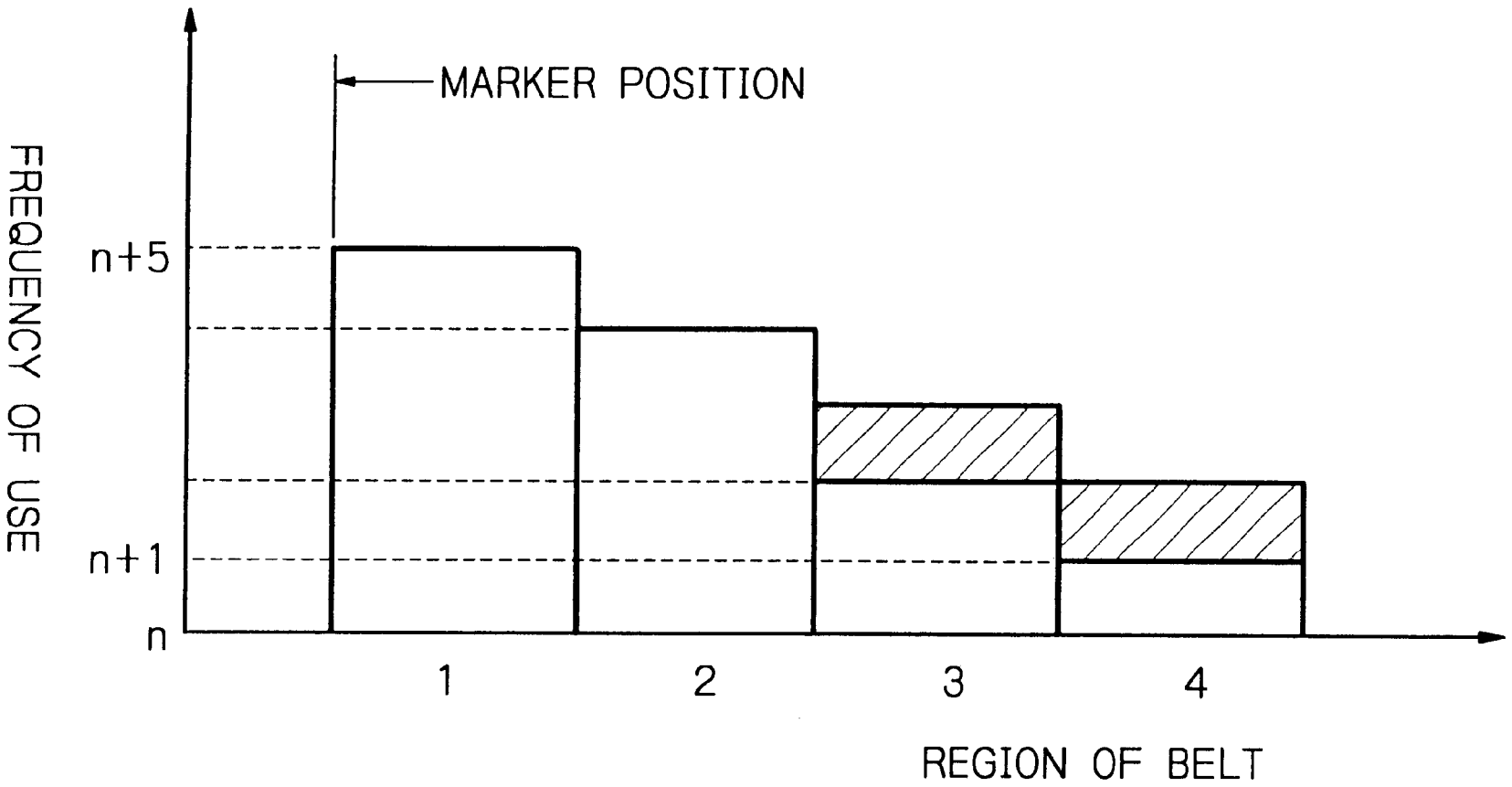

Specifically, the shortest image transfer length is substantially equal to the landscape size of format A6. When a desired image has the landscape A4 size by way of example, the control means 6 selects the region 3 of the belt 1, FIG. 8, as a transfer start region and executes image transfer by using the regions 3 and 4. As a result, the information stored in the memory are updated from the condition shown in FIG. 8 to a condition shown in FIG. 9.

Further, the control means 6 selects, among one or more regions included in the image transfer length of the belt, the region minimizing the total frequency of use stored in the nonvolatile memory as a transfer start position to the belt 1. This allows the belt 1 to be evenly used over its entire length. For example, assume that a landscape A6 size is the shortest image transfer length, and that an image of landscape A4 size is to be formed. Then, the image transfer length is the landscape A4 size. In this case, the region 3 shown in FIG. 8 is one of the two sections extending over the landscape A4 size which minimizes the total frequency of use. The control means 6 therefore selects the region 3 as a transfer start position and executes image transfer by using the regions 3 and 4.

Figure 10:
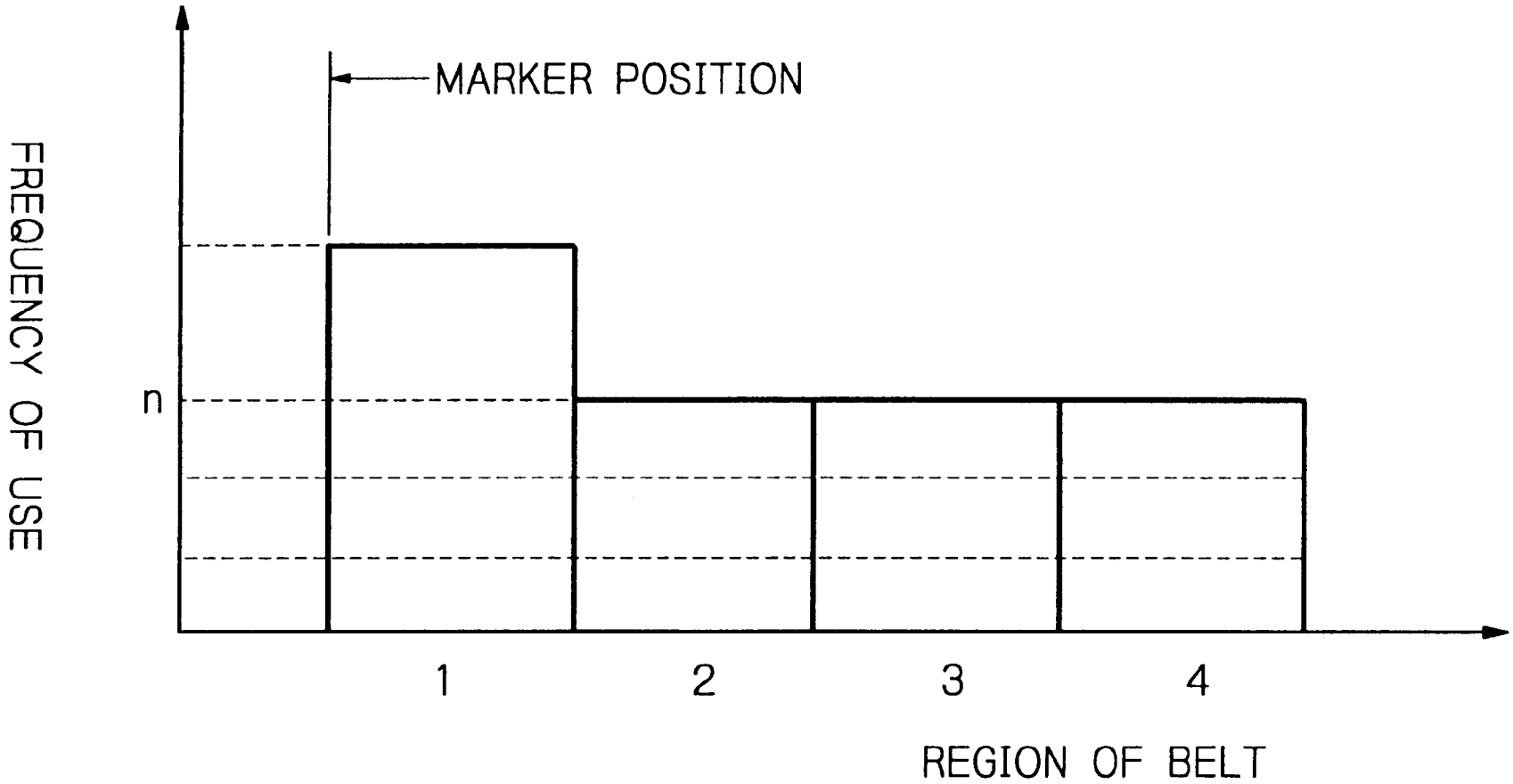

As shown in FIG. 10, assume that the frequency of use is lowest in two or more regions of the belt 1. Then, the region following and closes to the marker or reference position M1 is selected as a transfer start position to the belt 1. This reduces the period of time up to the end of printing and enhances high-speed image formation.

The region-by-region data relating to the belt 1 are stored in the nonvolatile memory and therefore prevented from being lost at the time of the power-down of the apparatus 100. In addition, when the belt 1 is implemented as a seamless belt, any desired transfer start position can be set.

While the apparatus 100 is shown and described as including the first and second image forming means 10 and 20, the present invention is similarly applicable to an image forming apparatus of the type including a single image forming section.

2nd Embodiment

Figures 11A, 11B, 11C, 11D, 11E, 12:
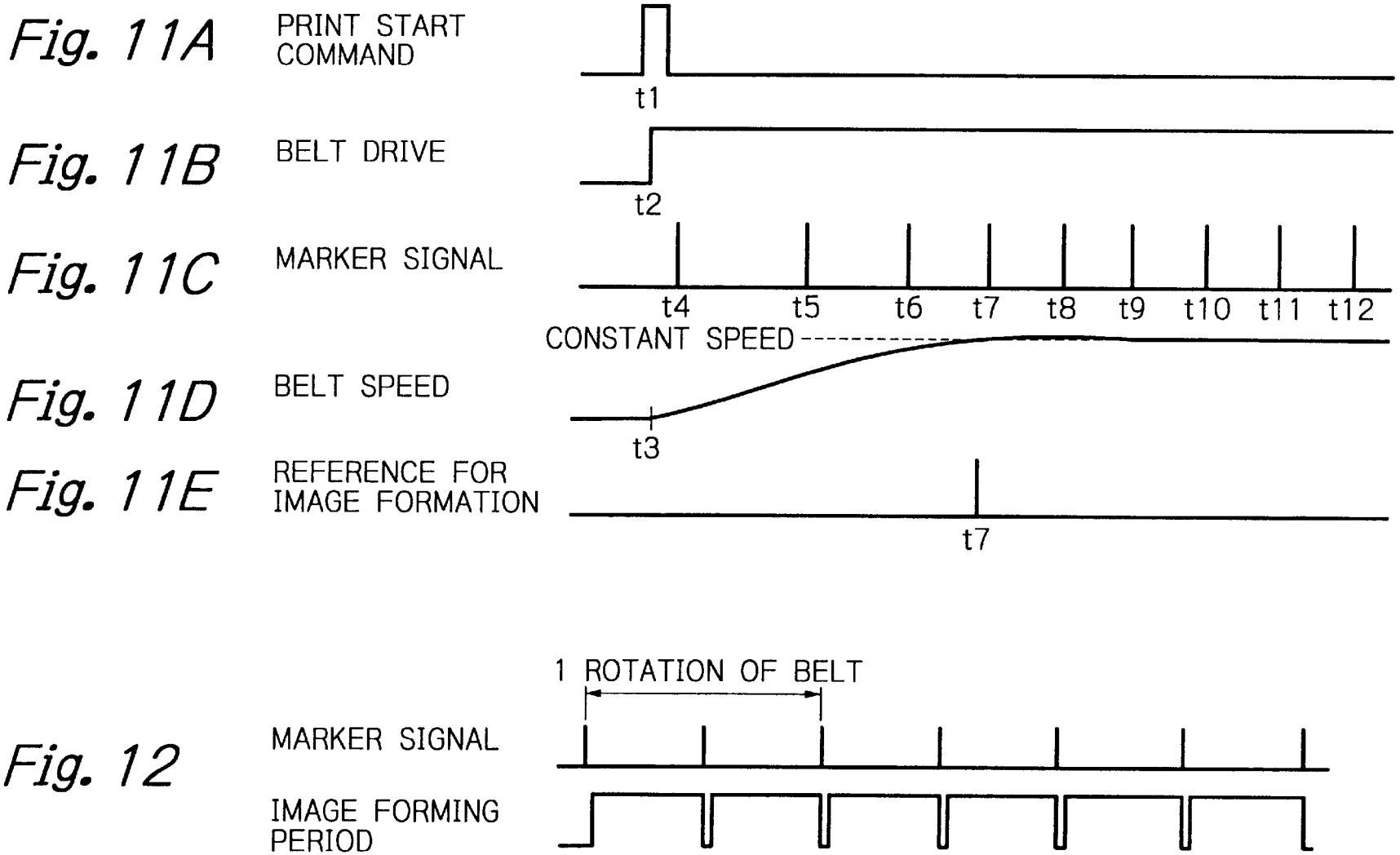
FIGS. 11A through 11E are timing charts demonstrating an image forming process including intermediate image transfer.
FIG. 12 is a timing chart showing a relation between the rotation of the belt and the image forming period.

This embodiment is also applicable to the image forming apparatus 100 shown in FIG. 2. As shown in FIG. 4, in this embodiment, a plurality of markers M are provided on the intermediate transfer belt 1. As shown in FIG. 11A, the apparatus 100 receives a print start command at a time t1. As shown in FIG. 11B, the belt 1 starts being driven at a time t2. Subsequently, as shown in FIG. 11D, the belt 1 starts moving at a time t3. The movement of the belt 1 is accelerated until it reaches a preselected speed. As shown in FIG. 11C, the sensing means 5 sequentially senses the markers M while outputting marker signals at times t4 through t12. In this specific case, the belt 1 reaches a constant speed at a time t7.

An image forming operation starts in response to the marker signal output at the time t7 for the first time after the belt 1 has reached the constant speed. Whether or no the belt 1 has reached the constant speed is determined on the basis of a period of time necessary for the belt 1 to reach the preselected speed set beforehand and by counting the drive time of the belt 1, as stated earlier, or by determining whether or not the consecutive marker signals appear at equal intervals.

Assuming that the belt 1 has the overall length L while the paper (image size) is l in the direction of rotation, then the length L is selected to be $2\times(l+\alpha)$. It is to be noted that $\alpha$ is the length of the non-image area of the belt 1 in the direction of rotation of the belt 1; $\alpha<<1$ holds.

Hereinafter will be described an image forming timing relating to a plurality of markers, e.g., two markers M1 and M2 shown in FIG. 3. The markers M1 and M2 are spaced from each other by a distance $(1+\alpha)$ in the direction of rotation of the belt 1. When the sensing means 5 senses the marker M1 at the previously mentioned time t7, an image starts being formed on the photoconductive drum. When the leading edge of the image formed on the drum reaches a preselected position adequate for transfer, i.e., on the elapse of a preselected period of time since the sensing of the marker M1, the image is transferred from the drum to the belt 1.

Soon after the image formation on the above drum over the length of a paper, the sensing means 5 senses the second marker M2 and causes the next image formation to start. Specifically, as shown in FIG. 12, two image forming periods occur during one rotation of the belt 1. Stated another way, the sensing means 5 senses the marker M2 just after the first image forming (writing) operation, so that the image forming means can immediately start the next image formation without any stand-by state.

With the above procedure, it is possible to increase the printing speed. Efficient image formation is achievable if the distance between the markers M1 and M2 is substantially equal to the shortest image length and if the intermediate transfer body has a circumferential length that is an integral multiple of the above distance.

The markers M, M1 and M2 may be implemented by aluminum-deposited polyester films or similar reflecting pieces adhered to the belt 1. In such a case the sensing means for sensing the markers will use the reflection of light. It follows that the sensing means 5 may be located at any desired position so long as it can emit and receive light. This enhances the free layout of the sensing means 5, compared to a case wherein an actuator or mechanical sensing means contacts the belt 1 for sensing markers implemented as projections and recesses. The sensing means 5 can therefore be positioned independently of the belt 1 and allows the belt 1 to be easily mounted and dismounted from the apparatus 100.

The markers M1 and M2, for example, may be provided on the inner surface of the belt 1. Such markers will be surely sensed despite the wear of the outer surface of the belt 1 ascribable to cleaning effected by a cleaning blade and the smearing of the edge of the belt 1 due to toner scattered by the cleaning blade. In addition, the sensing means 5 will be located in the space between the opposite runs of the belt 1 by effectively suing it and will thereby reduce the overall size of the apparatus 100.

As stated above, in the illustrative embodiment, a plurality of markers or reference positions are provided in the non-image area of the belt or intermediate transfer body 1. After the receipt of a print start command, the belt 1 is driven. When one of the markers is sensed for the first time after the belt 1 has reached a constant speed, an image forming operation starts. The apparatus 100 can therefore begin an image forming operation immediately after the receipt of the print start command. The printing speed can be increased if a new image forming operation is caused to start in response to a marker sensed for the first time after the preceding image forming operation.

Moreover, assume that the shortest image area is s. Then, in the illustrative embodiment, the markers provided on the belt 1 is spaced by a distance s while the circumferential length of the belt 1 is selected to be substantially n×s where n is 1 or greater integer. This is also successful to increase the printing speed.

Because the markers are implemented by reflecting pieces, the belt 1 does not have to be formed with holes or projections and recesses and is therefore free from damage. In addition, the apparatus 10 is miniaturized when the sensing means 5 is located between the opposite runs of the belt 1.

3rd Embodiment

In a repeat print mode, the apparatus 100 shown in FIGS. 3 through 6 does not start the next image forming cycle until the sensing means 5 senses a marker. That is, after the image transfer to the belt 1, the image forming means remains in a stand-by state until the next image forming cycle. In this embodiment, the image forming apparatus is constructed such that the image transfer body 1 is brought to a stop when a marker provided on the body 1 is sensed after an image forming operation.

Specifically, the markers M are provided on the belt or intermediate transfer body 1. Assume that after a printing operation starting when the sensing means 5 senses one marker M and ending when the cleaning blade removes the residual toner, a marker different from the above marker is sensed. Then, the apparatus stops driving the belt 1 and waits until the next print start command appears. This control is practicable with the control system shown in FIG. 13.

The illustrative embodiment therefore forms a new image on the belt 1 in an area different from the area where an image was previously formed. Because the number of markers provided on the belt 1 is known beforehand, the marker M used as a reference at the start of image formation can be easily determined by constantly counting the markers from the start to the end of the image forming operation.

4th Embodiment

In this embodiment, the image forming apparatus is also constructed such that the image transfer belt 1 is brought to a stop when a marker provided on the belt 1 is sensed after an image forming operation as in the previous embodiment. In this embodiment, on the elapse of a preselected period of time since the stop of drive of the intermediate transfer belt 1, the apparatus again drives the photoconductive drum and belt 1 until one marker has been sensed. Then, the apparatus again stops the movement of the drum and that of the belt 1 and sets up the stand-by state.

Specifically, as shown in FIGS. 3 and 4, the belt 1 is passed over the drive roller 2 and driven roller 3 and held under adequate tension by a tension roller not shown. If the drive roller 2 and driven roller 3 have their diameters reduced in order to miniaturize the apparatus, the curvature of the belt 1 will increase and will thereby cause the belt 1 to deform when held at the same position over a long period of time.

In light of the above, the apparatus of this embodiment once drives the belt 1 when the stand-by states continues for a preselected period of time, and then stops the belt 1 by using another marker as a reference. The preselected period of time is suitably varied in accordance with ambient temperature being sensed by the temperature sensor 7, FIG. 13, and input to the control means 6. Because the preselected period of time does not have to be accurately counted, a simple timer is usable and may count time every several hours. When the apparatus drives the belt 1 on the elapse of the above period of time, it sends a busy signal to the host computer in order to inhibit printing for a moment.

With the above construction, the illustrative embodiment sequentially shifts the portion of the belt 1 contacting the drive roller 2 or the driven roller 3 and thereby corrects the deformation of the belt 1. The belt 1 is therefore free from early deterioration ascribable to deformation and obviates the degradation of image quality ascribable to an image formed on the deformed portion of the belt 1. In addition, the early deformation of the belt 1 ascribable to varying ambient temperature is obviated.

The embodiments described so far are applicable not only to the image forming apparatus 100 shown in FIGS. 3 through 6, but also to a black-and-white image forming apparatus including only a single image forming means and a single or black developing means, i.e., the developing means 12'.

5th Embodiment

This embodiment is also practicable with the color image forming apparatus 100 shown in FIG. 3. Again, the intermediate transfer belt 1 has an overall length L. The distance between the markers M1 and M2 provided on the belt 1 is also $(l+\alpha)$ where l is the length of a paper or image size.

The operation of this embodiment is as follows. When the marker M1 of the belt 1 is sensed after the belt 1 has reached a constant speed, the first image forming means 10 starts forming the first image. The charging means 15 and writing means 16 form an A-color latent image. The A-color developing section 12 develops the A-color latent image to thereby form an A-color toner image. A transfer roller transfers the A-color toner image to the belt 1. After the formation of the A-color image, the image forming means 10 starts forming the second image when the next marker M2 is sensed. This is also followed by the above development and image transfer.

While the belt 1 conveys the first A-color toner image toward the second image forming means 20, the charging means 15' and writing means 16' of the image forming means 20 form a B-color latent image on the drum 14'. The B-color developing section 11' develops the latent image to thereby produce a B-color toner image. A transfer roller transfer the B-color toner image from the drum 14' to the belt 1 over the A-color toner image. As the second A-color toner image following the above A-color toner image arrives at the image forming means 20, the image forming means 20 transfers the second B-color toner image to the belt 1 over the second a-color toner image.

After the transfer of the second B-color image to the belt 1, the marker M1 used as a reference for the first image formation is again sensed. In response, the first image forming means 10 starts another image forming cycle. Specifically, the charging means 15 and writing means 16 form a C-color latent image on the drum 14. The C-color developing section 11 develops the latent image to thereby produce a C-color toner image. The C-color toner image is transferred from the drum 14 to the belt 1 over the first AB toner image existing on the belt 1. Subsequently, when the next marker M2 is sensed, the image forming means 10 starts forming the second C-color toner image.

While the belt 1 conveys the first ABC-color toner image toward the second image forming means 20, the charging means 15' and writing means 16' form a C-color latent image on the drum 14'. The D-color developing section 12' develops the D-color latent image. The resulting D-color toner image is transferred to the belt 1 over the ABC-color toner image present on the belt 1. Another D-color toner image is transferred to the belt 1 over the second ABC-color toner image reaching the second image forming means 20 later.

About the time when a full-color or ABCD-color image is completed on the belt 1, a paper is fed from a paper feed unit not shown. As a result, the full-color image is transferred to the paper and then fixed thereon. A cleaning unit, now shown, cleans the surface of the belt 1 after the above image transfer.

In a repeat print mode, after the writing of the second D-color image, the first image forming means 10 forms the third image when the marker M1 is again sensed. The above procedure is repeated to output a desired number of prints.

The previously stated embodiments are practicable even with this type of color image forming apparatus 100.

6th Embodiment

This embodiment is similar to the fifth embodiment except that the distance between the markers M1 and M2 provided on the intermediate transfer belt 1 is equal to the distance between the first and second image forming means 10 and 20. This allows the second image forming means 20 to start forming an image on the basis of the marker M2 which is sensed after the marker M1 used as a reference for the first image forming means. In addition, this configuration simplifies the control over the start of an image forming operation.

In the illustrative embodiment, the length L of the belt 1 is equal to $n \times m$ where m is the distance between the markers M1 and M2 and n is 1 or greater integer. When the belt 1 is implemented by a seamless belt, the markers M1 and M2 can be provided at any desired positions on the belt 1. In addition, an image forming or writing operation can be started in response to desired one of the markers M1 and M2.

The illustrative embodiment insures image formation free from defective image formation and defective image transfer even when the image length extends over a plurality of markers. The control means 6 prevents a marker sensed during image formation from being sent to the image forming means as an image area start signal.

7th Embodiment

This embodiment is also practicable with the image forming apparatus 100 shown in FIGS. 3 through 6. Assume that two or more markers are formed on the intermediate transfer belt 1 at preselected intervals; the number of markers should preferably be as great as possible. Also, assume that the belt 1 reaches a constant speed when moved by not more than one pitch of the markers. The belt 1 is formed of fluorine-contained resin and 0.15 mm thick. The drive roller 2 and driven roller 3 each have an outside diameter of 30 mm. A specific operation of the illustrative embodiment, i.e., control means 6 shown in FIG. 13 will be described with reference to FIGS. 14 through 16.

Figure 14:
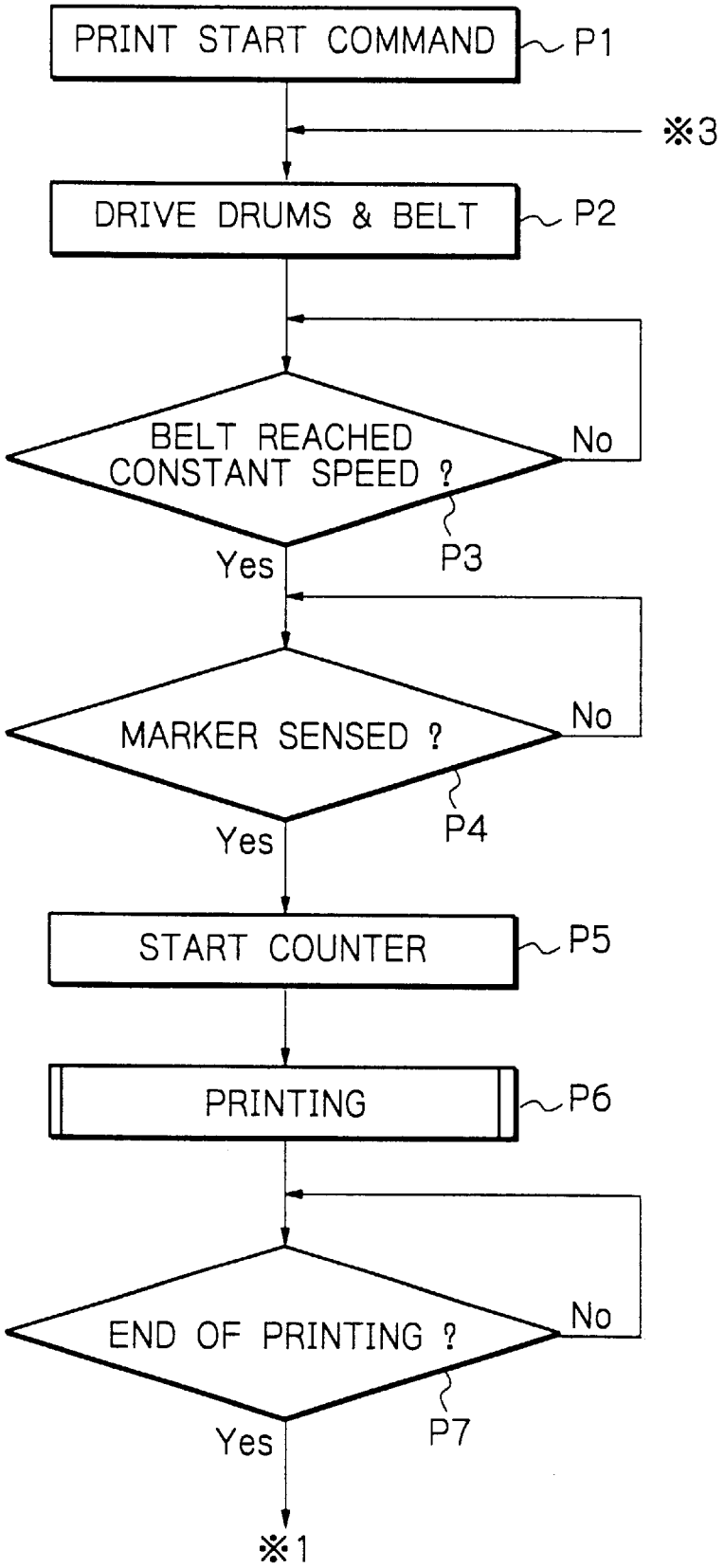
FIGS. 14 through 16 are flowcharts relating to control over the belt using markers.

As shown in FIG. 14, the control means 6 receives a print start command input on the control panel 22 (step P1) and causes the drums 14 and 14' and belt 1 to start rotating (step P2). The controller 6 then determines whether or not the belt 1 has reached a preselected constant speed necessary for starting printing (step P3). If the answer of the step P3 is positive (Yes), the control means 6 determines whether or not the sensing means 5 has sensed a marker for the first time (step P4). If the answer of the step P4 is Yes, the control means 6 causes a counter, not shown, to start counting markers (step P5). This is followed by image formation and image transfer to a paper (printing operation) executed by the first and second image forming means 20 (step P6).

Subsequently, the control means 6 determines whether or not the above printing operation has ended (step P7). If the answer of the step P7 is Yes, the operation is transferred to a step P8 shown in FIG. 15. In the step P8, the control means 6 updates the number of markers sensed from the start to the end of printing to n. The RAM stores the number of markers N corresponding to one rotation of the belt 1.

If the answer of the step P8 is Yes, the control means 6 compares the updated number n and the stored number N. If n is equal to N (No, step P9) and if the control means 6 immediately causes the belt 1 to stop rotating, then the same region of the belt 1 will undesirably be used for image formation at the time of the next printing. To solve this problem, if the count n is equal to N (No, step P9), the control means 6 continuously drives the belt 1 until the sensing means 5 senses the next marker (Yes, step P10). Subsequently, the control means 6 clears the counter and ends the operation (step P11) and then causes the belt 1 and drums 4 and 4' to stop rotating (step P12, FIG. 16).

By the above procedure, the position where the belt 1 stops is shifted by one pitch of the markers. Therefore, the belt 1 is not shifted any further from the position determined in the step P10 so long as the actual stand-by time to be described in the following steps P15 and P19 does not exceed a preselected allowable stand-by time. As a result, the next image forming region of the belt 1 is accurately shifted from the previous region by one pitch of the markers. This prevents exactly the same region of the belt 1 from being repeatedly used. It is to be noted that when the printing operation in the step P6 is effected in a repeat mode, the number N is automatically replaced with a preselected vale in accordance with the number of time of printing.

Figure 16:
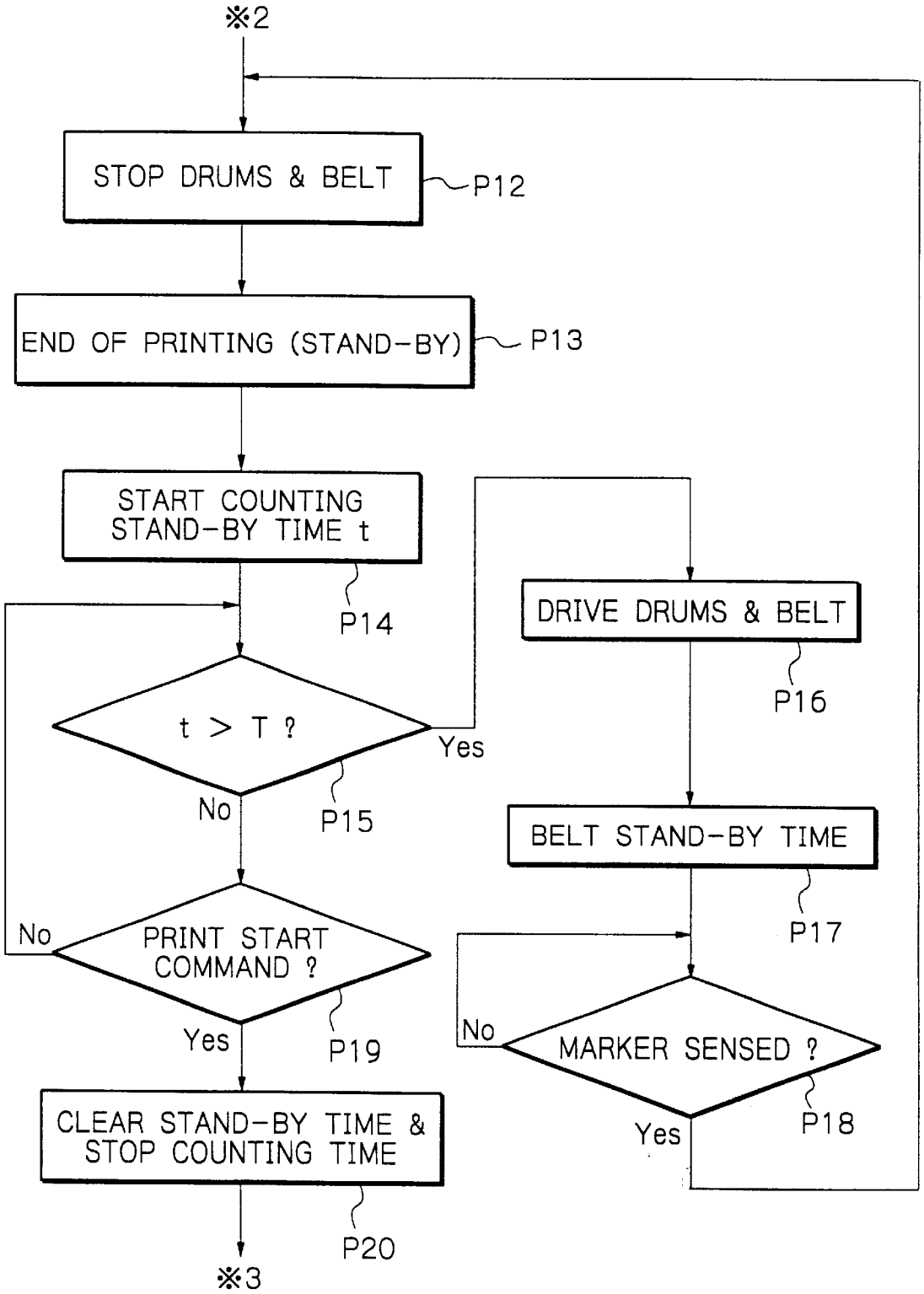

In FIG. 16, the control means 6 confirms the end of printing in a step P13 and sets up a stand-by state. In the stand-by state, the belt 1 remains stationary while being passed over the drive roller 2 and driven roller ;3. As a result, when the belt 1 and rollers 2 and 3 are provided with the previously stated dimensions, the belt 1 deforms along the curvatures of the rollers 2 and 3 in a long period of time. Should the next printing operation start in such a condition, the deformation of the belt 1 would adversely effect an image.

In light of the above, in the illustrative embodiment, the timer start counting time in a step P14. In the next step P15, the control means 6 compares a stand-by time t being actually counted by the timer and an allowable stand-by time T stored in the RAM. The allowable stand-by time T refers to a period of time over which the deformation of the belt 1 lies in an allowable range.

If a print start command appears before the actual stand-by time t exceeds the allowable stand-by time T (No, step P14 and Yes, step P19), the control means 6 clears the stand-by time T and causes the counter to stop counting the stand-by time t(step P20). After the step P20, the operation returns to the step P2, FIG. 14.

If the answer of the step P15 is Yes, meaning that the actual stand-by time t has exceeded the allowable stand-by time T, the control means 6 drives the belt 1 and drums 14 and 14' (step P16) and then resets th stand-by time t (step P17). The control means 6 continuously drives the belt 1 and drums 14 and 14' until the sensing means 5 senses the next marker (Yes, step P18). The step P18 is again followed by the step P12.

The above procedure drives the belt 1 intermittently in accordance with how many times the stand-by time t occurs and therefore causes its position to randomly vary at the time of printing. However, the image forming area is evenly distributed over the entire belt 1 for the long run.

As stated above, the illustrative embodiment causes a new image forming operation to start in response to a marker sensed after the previous image forming operation (step P4). Also, at the end of a printing operation, the illustrative embodiment stops the movement of the belt 1 in response to a marker different from a maker used as reference at the start of the printing operation. Further, when the actual stand-by time t exceeds the allowable stand-by time T, the illustrative embodiment causes the belt 1 to move and then stops the drive in response to a marker different from a marker having been used as a reference for a stop.

Figure 15:
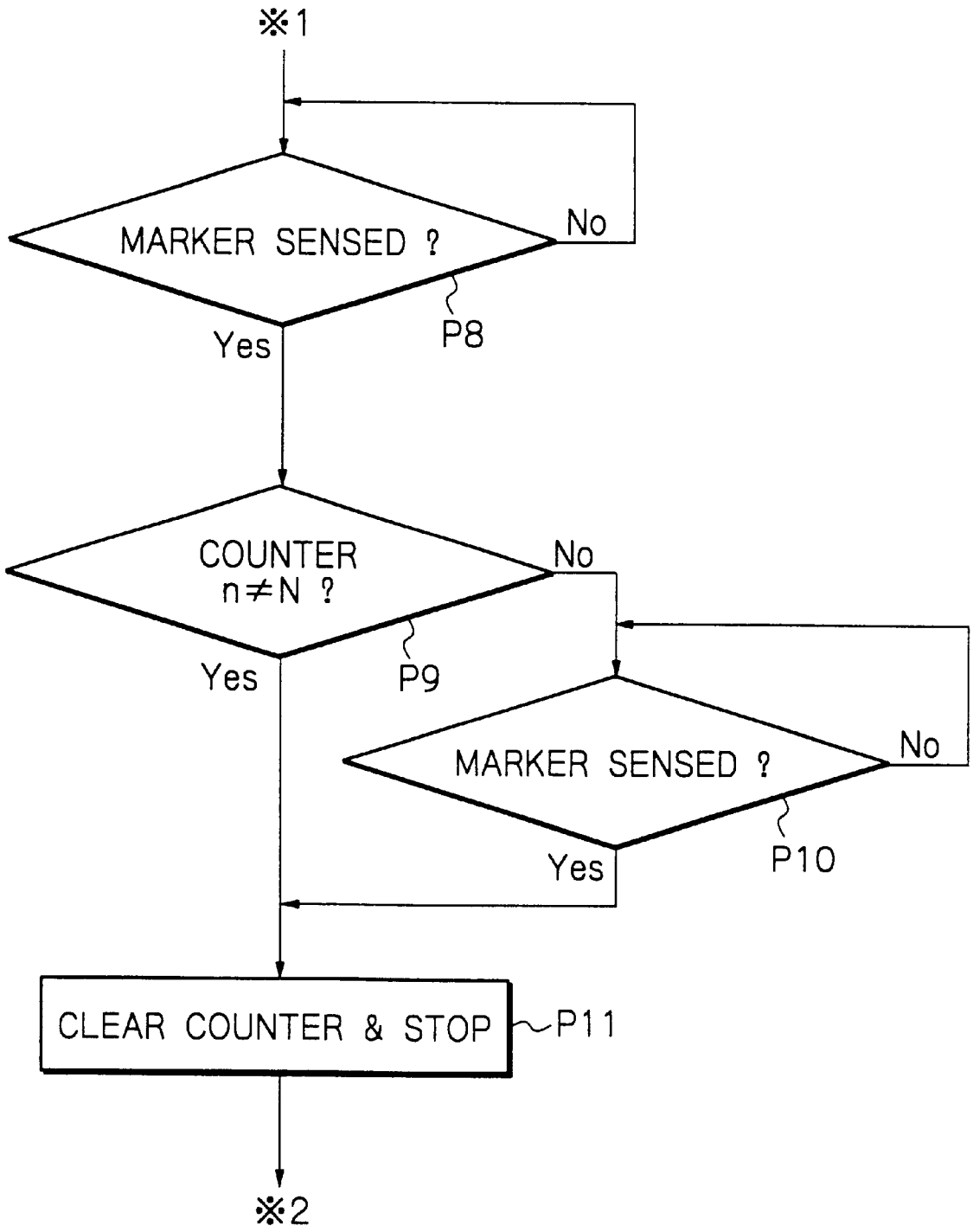

If desired, the step P7 shown in FIG. 14 may be immediately followed by the step P12 shown in FIG. 16, skipping the sequence of steps shown in FIG. 15. In such a case, every time the actual stand-by time t exceeds the allowable stand-by time T, the control means 6 will drive the belt 1 and then stop it at a position shifted from the previous stop position. This success fully allows the entire belt 1 to be evenly used and protects it from early deterioration while obviating the degradation of image quality ascribable to the deformation of the belt 1.

Hereinafter will be described a first and a second specific general configuration of an image forming apparatus to which the present invention is applicable.

Figure 17:
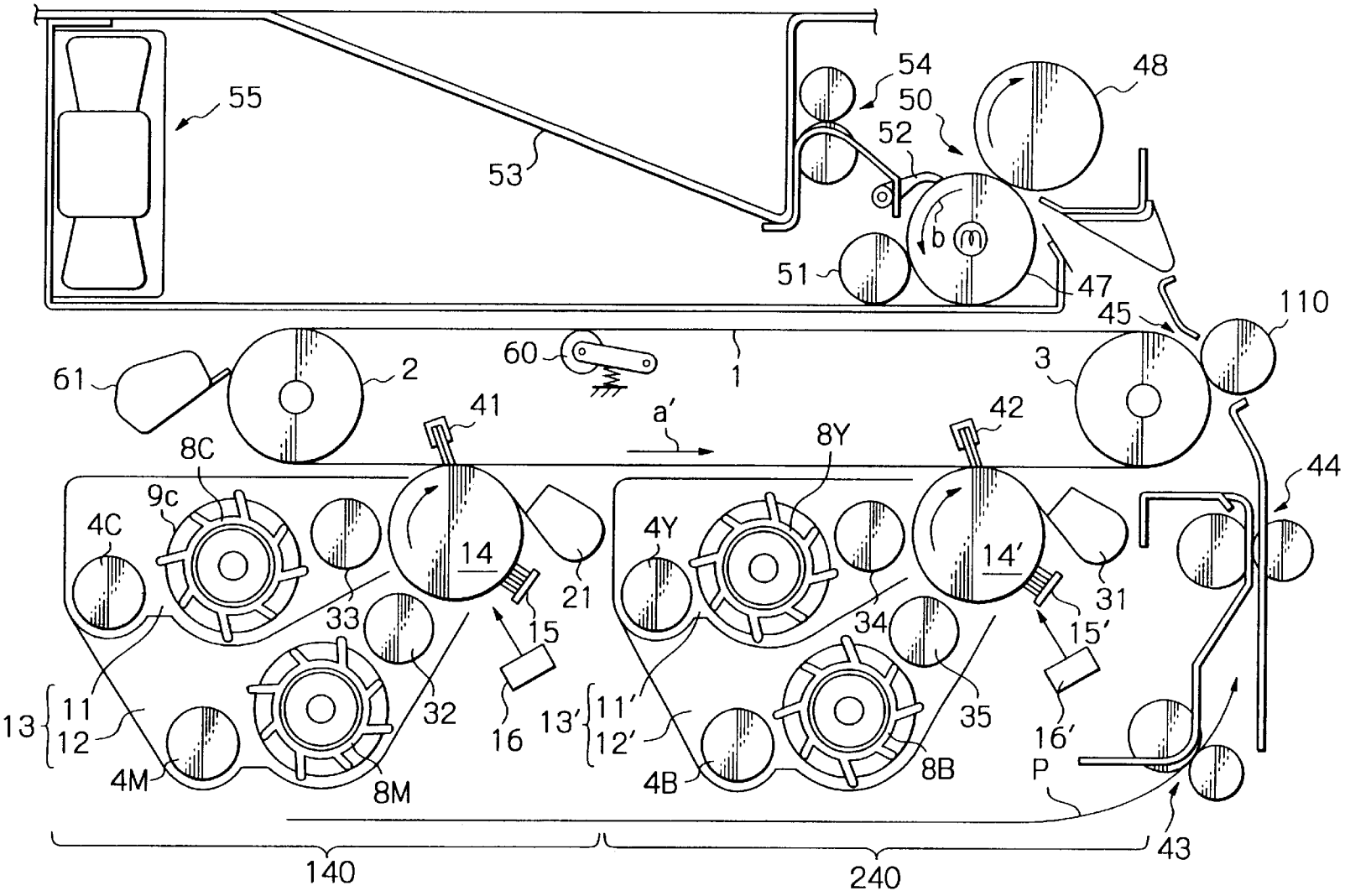
FIGS. 17 and 18 are front views each showing a particular configuration of the apparatus.

As shown in FIG. 17, the first specific configuration includes the intermediate transfer belt 1 passed over the drive roller 2 and driven roller 3. The drive roller 2 causes the belt 1 to move in a direction indicated by an arrow a' in FIG. 17. A tension roller 60 provides the belt 1 with an adequate degree of tension. The first and second image stations 140 and 240 are arranged below the belt 1 and spaced from each other by a preselected distance in the direction in which the belt 1 runs. The first and second image stations 140 and 240 include the first and second image forming means 10 and 20, respectively. The belt 1 is longer than the length of a paper of maximum size, as measured in the direction of movement of the paper, by the length of the non-image area.

The first image station 140 includes the drum or image carrier 14, brush-like charging means 15 for uniformly charging the drum 14, writing means 16 for writing an image on the charged surface of the drum 14 with a beam modulated by an image signal representative of a document, A-color developing section 12, C-color developing section 11, and cleaning means 21. The developing means 12 and 11 constitute the developing mans 13.

Likewise, the second image station 240 includes th drum 14, charging means 14, writing means 16, B-color developing section 11', D-color developing section 12', and cleaning means 31. The developing means 11' and 12' constitute the developing mans 13. The second image station 240 is mounted on the apparatus body in the same posture as the first image station 140.

The image stations 140 and 240 each are removable from the apparatus body. The drums 14 and 14' are rotated in synchronism with the movement of the belt 1 at a peripheral speed precisely equal to the running speed of the belt 1. The charging means 15 and 15' may be replaced with corona dischargers or discharge rollers, if desired.

Each developing section stores a two-ingredient type developer of particular color. Specifically, the A-color developing section 12 stores a mixture of magenta toner and carrier while the C-color developing section 11 stores a mixture of cyan toner and carrier. Likewise, the B-color developing section 11' and D-color developing section 12' respectively store a mixture of yellow toner and carrier and a mixture of black toner and carrier. The charging means 15 and writing means 16 and the charging means 15' and writing means 16' respectively form latent images on the drums 14 and 14' by the conventional method. Developing rollers 32, 33, 34 and 35 each develop a particular latent image formed on associated one of the drums 14 and 14'. The developing rollers or developing means 32, 33, 34 and 35 each are made up of a stationary magnet roller and a nonmagnetic sleeve rotatable around the magnet roller (magnet brush development system).

The developing sections 11, 12, 11' and 12' each include a respective paddle or agitating member and a respective conveyor screw or toner replenishing member. Each developing section may be implemented by a conventional color developing section, e.g., one taught in Japanese Patent Laid-Open Publication No. 8-160697. Specifically, conveyor screws 4M, 4C, 4Y and 4B each are implemented by a spiral blade. Paddles 8M, 8C, 8Y and 8B each are made up of a spiral blade 9*c* and eight radially extending plates in order to convey the associated developer while agitating it. The paddle 8M and conveyor screw 4M convey the developer in opposite directions to each other so as to evenly distribute it in the axial direction of the developing roller 32.

A first transfer brush 41 is movable into and out of contact with the drum 14 with the intermediary of the belt 1 and applied with a bias for image transfer. Likewise, a second transfer brush 42 is movable into and out of contact with the drum 14' with the intermediary of the belt 1 and applied with a bias for image transfer. A transfer roller 10 is movable into and out of contact with the driven roller 3 with the intermediary of the belt 1 and applied with a bias for image transfer. The transfer brushes 41 and 42 may be replaced with transfer rollers or corona dischargers, if desired.

The drums 14 and 14' are usually slightly spaced below the belt 1 while the transfer brushes 41 and 42 are usually slightly spaced above the belt 1. At the time of transfer of a toner image formed on the drum 14 or 14', the transfer brush 41 and/or the transfer brush 42 causes the belt 1 to contact the drum 14 and/or the drum 14'.

The driven roller 3 and transfer roller 110 define a transfer position 45 for transferring a full-color image to a paper. The transfer roller 110 may be replaced with a corona discharger or a transfer brush, if desired. A cleaning unit 61 is movable into and out of contact with the drive roller 2 for removing toner left on the belt 1 after image transfer.

A paper feed unit, not shown, is positioned below the image stations 140 and 240 for sequentially feeding papers stacked thereon one by one. A paper P fed from the paper feed unit is conveyed to the transfer position 45 by way of a conveyor roller pair 43 and a registration roller pair 44. A fixing unit 50 is positioned obliquely above the transfer position 45 and made up of a heat roller 47 and a press roller 48 pressed against the heat roller 47. The heat roller 47 is rotatable in a direction indicated by an arrow b in FIG. 17. A roller 51 is brought into the heat roller 47 for applying an anti-offset liquid to the heat roller 47, as needed. Further, a peeler 52 for peeling off the paper P is held in contact with the heat roller 47.

an outlet roller pair 54 is positioned downstream of the fixing unit 50 in the direction of movement of the paper P and drives the paper P coming out of the fixing unit 50 onto a tray 53. An exhaust fan 55 is located in the upper left portion of FIG. 17 in order to protect electric parts positioned below the tray 53 from heat radiated from the fixing unit 50.

The drums 14 and 14' are identical in shape, size and material and driven at the same linear velocity.

Figure 18:
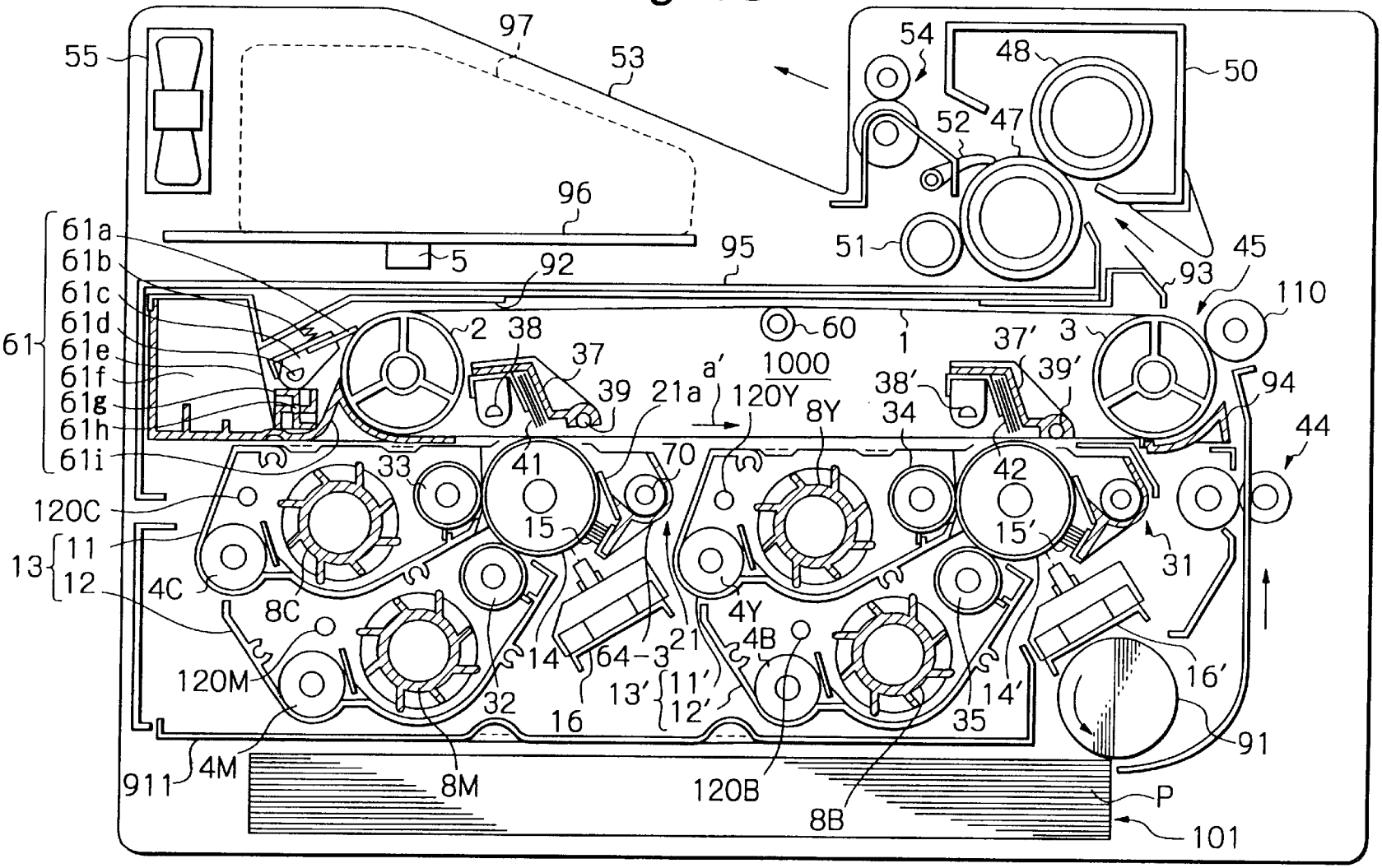

FIG. 18 shows the second specific configuration that is more detailed than the first specific configuration. As shown, the first transfer brush 41 is supported by a body 37 angularly movable about a shaft 38 which is, in turn, supported by a stationary member. The transfer brush 41 is mounted on the free end of the body 37. A transfer roller 39 is also mounted on the free end of the body 37. While the transfer brush 41 may be constantly held in contact with the belt 1, the body 37 of this configuration is so controlled as to bring the brush 41 into contact with the belt 1 only when a toner image is to be transferred from the drum 14 to the belt 1 in order to avoid wear. Therefore, the transfer brush 41 and transfer roller 39 are spaced from the belt 1 except when the above image transfer occurs.

An arrangement around the second transfer brush 42 is identical with the above arrangement around the first transfer brush 42 and includes an angularly movable body 37', a shaft 38', and a transfer roller 39' and will not be described specifically. The two transfer brushes 41 and 42 each contact the belt at a particular timing. FIG. 18 shows a condition wherein the transfer brush 41 and transfer roller 39 are spaced from the belt 1 while the transfer brush 42 and transfer roller 39' are held in contact with the belt 1.

In the condition shown in FIG. 18, the transfer brush 42 and transfer roller 39' contact the drum 14' with the intermediary of the belt 1 while being spaced from each other. This allows the belt 1 to contact the drum 14' over a preselected nip width and thereby enhances transferability. The other transfer brush 41 and transfer roller 39 are also brought into contact with the belt 1 when a toner image is to be transferred from the drum 14 to the belt 1. Of course, the transfer rollers 39 and 39' and transfer brushes 41 and 42, as well as the members associated therewith, each extend in the direction perpendicular to the sheet surface of FIG. 18 over the same width as the belt 1.

The cleaning unit 61 includes a blade 61*a* movable into and out of contact with the belt 1 and supported by an angularly movable body 61*c*. The body 61*c* is mounted on a shaft 61*d*. A compression spring or biasing means 61*b* constantly biases the body 61*c* toward the belt 1. A guide 61*l* guides downward the toner and paper dust scraped off by the blade 61*a*. A swastika-shaped rotary member 61*g* is positioned below the guide 61*i*. A leaf spring 61*e* contacts the rotary member 61*g* at its free end. A box 61*g* is positioned at the side opposite to the rotary member 61*g* with respect to the leaf spring 61*e*.

The rotary member 61*g* is rotatable about a shaft 61*h*. The other end of the leaf spring 61*e* is affixed to a frame 92. Drive means, not shown, is drivably connected to the shaft 61*d*. The drive means is controlled such that the body 61*c* selectively releases the blade 61*a* from the belt 1 against the action of the compression spring 61*b* or brings it into contact with the belt 1 under the action of the spring 61*b*.

The blade 61 is usually spaced from the belt 1 so as not to disturb a toner image existing on the belt 1. Only when the toner, paper dust and other impurities left on the belt 1 after image transfer to the paper P should be removed, the blade 61 is brought into contact with the belt 1. The impurities removed from the belt 1 by the blade 61 drop to the rotary member 61*g* along the guide 61*l* due to their own weight.

The rotary body 61*g* in rotation causes the leaf spring 61*e* to intermittently deform and deliver the collected impurities to the box 61*f*. Of course, the blade 61*a*, guide 61*l*, rotary member 61*g* and box 61*f*, as well as the members associated therewith, each extend in the direction perpendicular to the sheet surface of FIG. 18 over the same width as the belt 1.

In this specific configuration, the conveyor roller pair 43, FIG. 17, is absent while a pickup roller 91 is positioned on the top of a paper stack P. The pickup roller 91 is journalled to stationary members and caused to rotate by a driveline at the time of sheet feed. The papers P are stacked on a bottom plate, not shown, while being positioned by guides, not shown. The pickup roller 91 pays out the top paper P first. As the pickup roller 91 sequentially feeds the papers P, the bottom plate is sequentially raised such that the top paper P is held in contact with the pickup roller 91 under preselected adequate pressure. This kind of control is conventional and will not be described specifically. The conveyor roller pair 43 may also be included in this specific configuration, if desired.

The cleaning means 21 includes a blade 21*a* extending over the axial length of the drum 14. The blade 21*a* scrapes off toner left on the drum 14. The removed toner is collected in a shaft supporting portion 64-3 having a generally U-shaped section and having substantially the same widthwise dimension as the blade 21*a*. An auger 70 rotates to convey the toner from the shaft supporting portion 64-3 to a box-like portion located at one end of a drum unit in the widthwise direction. The other cleaning means 31 is identical in configuration with the cleaning means 21.

The various structural elements of the above specific configuration are grouped or constructed into units. For example, the portion accommodating the paper stack P is positioned at the lowermost portion of the apparatus and isolated by a partition 911. The developing means 13 and 13' as well as other structural elements are positioned above the partition 911. The partition covering the paper stack P prevents the toner handled by the developing means 13 and 13' from dropping onto the paper stack P.

The writing means 16 and 16', developing means 13 and 13' and drum units are arranged in the space between the partition 911 and the belt 1. Among them, the writing means 16 and drum unit accommodating the drum 14 are removably mounted to the side walls of the apparatus body via shared members. Also, the developing means 13 and 13' each are constructed into a unit and removably mounted to the above side walls via the shared members.

The developing sections 12, 11, 11' and 12' are respectively formed with holes 120M, 120C, 120Y and 120B for replenishing toner to the developing sections.

The belt 1 and the drive roller 2, driven roller 3, transfer roller 110, transfer brushes 41 and 42, transfer rollers 39 and 39' and cleaning unit 61 associated with the belt 1 are accommodated in a flat box 98, constituting an intermediate transfer unit 1000. The box 98 is mainly constituted by the frame 93 playing the role of a paper guide at the same time, guide 61*l*, and guide 94.

The intermediate transfer unit 1000 is supported by a guide below a partition 95 and removable from the apparatus. The sensing means 5 is positioned above the drive roller 2 for sensing the markers provided on the widthwise edge of the belt 1, as stated earlier. Various timings included in the image forming process are set on the basis of the output of the sensing means 5. At the same time, the number of rotations of the belt 1 is calculated. The sensing means 5 is mounted to a board 96 either directly or via a socket. Electric parts are arranged in a space 97 above the board 96 for driving and controlling the apparatus. The exhaust fan 55 discharges air inside the apparatus including heat radiated from the electric parts.

The operation of the above image forming apparatus will be described with reference to FIG. 17, assuming the previously stated equation $L=m+\alpha$.

The charging means 15 and writing means 16 of the first image station 140 write an A-color latent image on the drum 14. The A-color developing section 12 develops the latent image to form an A-color toner image or magenta toner image (M toner image hereinafter). The transfer brush 41 transfers the M toner image to the belt 1.

While the belt 1 running in the direction a' conveys the M toner image toward the second image station 240, the charging means 15' and writing means 16' write a B-color latent image on the drum 14'. The B-color developing section 11' develops the latent image to form a B-color toner image or yellow toner image (Y toner image hereinafter). The transfer brush 42 transfers the Y toner image to the belt 1 over the M toner image existing on the belt 1, thereby forming an MY toner image.

While the belt 1 conveys the MY toner image toward the first image station 140, the charging means 15 and writing means 16 write a C-color latent image on the drum 14. The C-color developing section 11 develops the latent image to form a C-color toner image or cyan toner image (C toner image hereinafter). The transfer brush 41 transfers the C toner image to the belt 1 over the MY toner image, thereby forming an MYC toner image.

While the belt 1 conveys the MYC toner image toward the second image station 240, the charging means 15' and writing means 16' write a D-color latent image on the drum 14'. The D-color developing section 12' develops the latent image to form a D-color toner image or black toner image (BK toner image hereinafter). The transfer brush 42 transfers the BK toner image to the belt 1 over the MYC toner image, thereby forming an MYCBK or full-color toner image.

About the time when the full-color image is completed on the belt 1 by the transfer brush 42, the paper P fed from the paper feed unit arrives at the transfer section 45 via the registration roller 44. As a result, the full-color image is transferred from the belt 1 to the paper P, fixed on the paper P by the fixing unit 50, and then driven out to the tray 53 by the outlet roller pair 54. After the image transfer from the belt 1 to the paper P, the cleaning unit 61 cleans the belt 1.

In a repeat print mode, when the MY toner image is transferred to the belt 1 at the second image station 240, the first image station 140 transfers another M toner image to the belt 1. Thereafter, the above procedure is repeated to produce a desired number of prints.

In summary, it will be seen that the present invention provides an image forming apparatus having various unprecedented advantages, as enumerated below.

(1) An intermediate transfer body is evenly used over its entire length and therefore free from local wear. This protects the intermediate transfer body from early deterioration.

(2) The intermediate transfer body can be efficiently used.

(3) An image can be formed in a short period of time.

(4) Even at the time of power-down of the apparatus, frequencies of use stored one-to-one correspondence to the sections of the intermediate transfer body are not lost.

(5) A plurality of markers each defining a reference at the time of the start of image formation are provided on the intermediate transfer belt. When the apparatus is controlled such that after one image forming operation the apparatus is not immediately brought to a stand-by state on detecting a marker, a printing speed can be increased.

(6) Because an image is formed in the region of the intermediate transfer belt that is different from the previous image forming region, the intermediate transfer body is free from early deterioration and deformation.

(7) When the intermediate transfer body is implemented as a belt, a toner image of at least three primary colors is transferred from image carriers to the belt. Therefore, even in a color image forming apparatus, there can be achieved a high print speed and the obviation of the early deterioration of the belt.

(8) Control over the start of image formation is simplified.

(9) The portions of the belt contacting rollers do not deform and therefore prevents image quality from being lowered due to their deformation.

Various modifications will become possible for those skilled in the art after receiving the teachings of the present disclosure without departing from the scope thereof.

What is claimed is:

1. An image forming apparatus comprising:

an image forming section for forming a toner image on an image carrier;

an intermediate transfer body to which the toner image is transferred from said image carrier;

a transferring device for transferring the toner image from said intermediate transfer body to a sheet-like recording medium;

storing means for storing a frequency of use of each of a plurality of regions of said intermediate transfer body; and selecting means for selecting, in accordance with frequencies of use stored in said storing means, a transfer start position on said intermediate transfer body where a transfer of the toner image to said intermediate transfer body should start.

2. An apparatus as claimed in claim 1, wherein each of said plurality of regions corresponds to a shortest image transfer length available with said apparatus.

3. An apparatus as claimed in claim 2, wherein said selecting means selects, as said transfer start position, one or more of said plurality of regions which minimize a sum of the frequencies of use.

4. An apparatus as claimed in claim 3, wherein when two or more regions minimizing the sum of the frequencies of use exist, the region closest to a marker provided on said intermediate transfer body is selected as a reference position.

5. An apparatus as claimed in claim 4, wherein said storing means comprises a nonvolatile memory.

6. An apparatus as claimed in claim 3, wherein said storing means comprises a nonvolatile memory.

7. An apparatus as claimed in claim 2, wherein said storing means comprises a nonvolatile memory.

8. An apparatus as claimed in claim 1, wherein said selecting means selects, as said transfer start position, one or more of said plurality of regions which minimize a sum of the frequencies of use.

9. An apparatus as claimed in claim 8, wherein when two or more regions minimizing the sum of the frequencies of use exist, the region closest to a marker provided on said intermediate transfer body is selected as a reference position.

10. An apparatus as claimed in claim 9, wherein said storing means comprises a nonvolatile memory.

11. An apparatus as claimed in claim 8, wherein said storing means comprises a nonvolatile memory.

12. An apparatus as claimed in claim 1, wherein said storing means comprises a nonvolatile memory.

13. An image forming apparatus comprising:

a plurality of image forming sections each including a respective image carrier for forming a toner image on said respective image carrier, a respective optical writing device for optically writing a latent image on said respective image carrier, at least two developing devices each for developing the latent image with toner of particular color, and switching means for selecting one of said two developing devices;

an intermediate image transfer body to which the toner image is transferred;

a transferring device for transferring a composite toner image from said intermediate transfer body to a sheet-like recording medium;

storing means for storing a frequency of use of each of a plurality of regions of said intermediate transfer body; and selecting means for selecting, in accordance with frequencies of use stored in said storing means, a transfer start position where a transfer of the toner image to said intermediate transfer body should start.

14. An apparatus as claimed in claim 13, wherein each of said plurality of regions corresponds to a shortest image transfer length available with said apparatus.

15. An apparatus as claimed in claim 14, wherein said selecting means selects, as said transfer start position, one or more of said plurality of regions which minimize a sum of the frequencies of use.

16. An apparatus as claimed in claim 15, wherein when two or more regions minimizing the sum of the frequencies of use exist, the region closest to a marker provided on said intermediate transfer body is selected as a reference position.

17. An apparatus as claimed in claim 16, wherein said storing means comprises a nonvolatile memory.

18. An apparatus as claimed in claim 15, wherein said storing means comprises a nonvolatile memory.

19. An apparatus as claimed in claim 14, wherein said storing means comprises a nonvolatile memory.

20. An apparatus as claimed in claim 13, wherein said selecting means selects, as said transfer start position, one or more of said plurality of regions which minimize a sum of the frequencies of use.

21. An apparatus as claimed in claim 20, wherein when two or more regions minimizing the sum of the frequencies of use exist, the region closest to a marker provided on said intermediate transfer body is selected as a reference position.

22. An apparatus as claimed in claim 21, wherein said storing means comprises a nonvolatile memory.

23. An apparatus as claimed in claim 20, wherein said storing means comprises a nonvolatile memory.

24. An apparatus as claimed in claim 13, wherein said storing means comprises a nonvolatile memory.

25. An image forming apparatus comprising:

an intermediate transfer belt configured to be driven over rollers and provided with a plurality of reference markers; and a controller configured to start a new image forming operation upon sensing one of said plurality of markers after a prior image forming operation has been completed, wherein said intermediate transfer belt is driven from a first stand-by state position to a second stand-by state position when a stand-by state continues longer than a preselected time period.

26. An image forming apparatus comprising:

an intermediate transfer belt configured to be driven over rollers and provided with a plurality of reference markers;

a controller configured to start a new image forming operation upon sensing one of said plurality of markers after a prior image forming operation has been completed; and first and second image forming devices arranged along said intermediate transfer belt at a preselected distance from each other, wherein said first and second image forming devices each comprise a respective image carrier and respective developing device configured to develop latent images sequentially formed on said respective image carrier with developers of at least two colors and said markers are spaced from each other by a same distance as said first and second image forming devices, whereby toner images of at least three primary colors are sequentially transferred to said intermediate transfer body one above the other to form a color image.

27. An apparatus as claimed in claim 26, wherein said intermediate transfer belt is driven from a first stand-by state position to a second stand-by state position when a stand-by state continues longer than a preselected time period.

28. An image forming apparatus comprising:

an intermediate transfer body configured to be held in a stand-by state upon detection of, after an image forming operation, a reference marker provided on said intermediate transfer body configured to trigger image formation, wherein the reference marker is one of a plurality of markers provided on said intermediate transfer body, and said intermediate transfer body is brought to a stop at an end of a printing operation by use of a marker other than the reference marker.

29. An apparatus as claimed in claim 28, wherein toner images of at least three primary colors are transferred to said intermediate transfer body one above the other.

30. An apparatus as claimed in claim 29, further comprising first and second image forming devices arranged along a movable surface of said intermediate transfer body at a preselected distance from each other, said first and second image forming devices each comprising a respective image carrier and respective developing device configured to develop latent images sequentially formed on said respective image carrier with developers of at least two colors, whereby toner images are sequentially transferred to said intermediate transfer body one above the other to form a color image.

31. An apparatus as claimed in claim 30, wherein said markers are spaced from each other by a same distance as said first and second image forming devices.

32. An apparatus as claimed in claim 31, wherein said intermediate transfer body comprises an intermediate transfer belt configured to be driven over rollers, and said intermediate transfer belt is driven from a first stand-by state position to a second stand-by state position when a stand-by state continues longer than a preselected time period.

33. An apparatus as claimed in claim 30, wherein said intermediate transfer body comprises an intermediate transfer belt configured to be driven over rollers, and said intermediate transfer belt is driven from a first stand-by state position to a second stand-by state position when a stand-by state continues longer than a preselected time period.

34. An apparatus as claimed in claim 29, wherein said intermediate transfer body comprises an intermediate transfer belt configured to be driven over rollers, and said intermediate transfer belt is driven from a first stand-by state position to a second stand-by state position when a stand-by state continues longer than a preselected time period.

35. An apparatus as claimed in claim 28, wherein said intermediate transfer body comprises an intermediate transfer belt configured to be driven over rollers, and said intermediate transfer belt is driven from a first stand-by state position to a second stand-by state position when a stand-by state continues longer than a preselected time period.

36. An image forming apparatus comprising:

an intermediate transfer body configured to be held in a stand-by state upon detection of, after an image forming operation, a reference marker provided on said intermediate transfer body configured to trigger image formation, wherein said reference marker is one of a plurality of markers and said intermediate transfer body is driven and subsequently brought to a stop upon sensing a marker other than the reference marker when said stand-by state continues longer that a preselected period of time.

37. An apparatus as claimed in claim 36, wherein toner images of at least three primary colors are transferred to said intermediate transfer body one above the other.

38. An apparatus as claimed in claim 37, further comprising first and second image forming devices arranged along a movable surface of said intermediate transfer body at a preselected distance from each other, said first and second image forming devices each comprising a respective image carrier and respective developing device configured to develop latent images sequentially formed on said respective image carrier with developers of at least two colors, whereby toner images are sequentially transferred to said intermediate transfer body one above the other to form a color image.

39. An apparatus as claimed in claim 38, wherein said markers are spaced from each other by a same distance as said first and second image forming devices.

40. An apparatus as claimed in claim 39, wherein said intermediate transfer body comprises an intermediate transfer belt configured to be driven over rollers, and said intermediate transfer belt is driven from a first stand-by state position to a second stand-by state position when a stand-by state continues longer than a preselected time period.

41. An apparatus as claimed in claim 38, wherein said intermediate transfer body comprises an intermediate transfer belt configured to be driven over rollers, and said intermediate transfer belt is driven from a first stand-by state position to a second stand-by state position when a stand-by state continues longer than a preselected time period.

42. An apparatus as claimed in claim 37, wherein said intermediate transfer body comprises an intermediate transfer belt configured to be driven over rollers, and said intermediate transfer belt is driven from a first stand-by state position to a second stand-by state position when a stand-by state continues longer than a preselected time period.

43. An apparatus as claimed in claim 36, wherein said intermediate transfer body comprises an intermediate transfer belt configured to be driven over rollers, and said intermediate transfer belt is driven from a first stand-by state position to a second stand-by state position when a stand-by state continues longer than a preselected time period.

44. An image forming apparatus comprising:

an image forming section configured to form a toner image on an image carrier;

an intermediate transfer belt passed over rollers and to which the toner image is transferred from said image carrier; and a transferring device configured to transfer the toner image from said intermediate transfer belt to a sheet-like recording medium;

said intermediate transfer belt stopping a movement and entering a stand-by state upon ending a preselected image forming job;

wherein every time a preselected period of time elapses, said intermediate transfer belt is driven and then stopped at a position shifted from a previous stand-by position to thereby enter the stand-by state.

45. A method of forming a toner image on a sheet-like recording medium, comprising the steps of:

forming said toner image on an image carrier, transferring said toner image to a rotatable intermediate transfer belt passed over rollers, and transferring said toner image from said intermediate transfer belt to said recording medium, wherein a plurality of markers are provided over an entire circumference of said intermediate transfer belt at preselected intervals, and when a movement of said intermediate transfer belt is stopped upon ending a preselected image forming operation and said movement is stopped at a same marker used as a reference at an ending time of a previous image forming operation, said movement is stopped by using a marker next to said reference marker.

46. A method of forming a toner image on a sheet-like recording medium comprising the steps of:

forming said toner image on an image carrier, transferring said toner image to a rotatable intermediate transfer belt passed over rollers, and transferring said toner image from said intermediate transfer belt to said recording medium, wherein a plurality of markers are provided over an entire circumference of said intermediate belt at preselected intervals, said movement of said intermediate transfer belt is stopped by referencing a marker other then a marker used to reference an end of a previous image forming operation when a movement of said intermediate transfer belt is stopped upon ending a preselected image forming operation, and every time said intermediate transfer belt is held in a stand-by state longer than a preselected period of time, said intermediate transfer belt is driven and then subsequently brought to a stop using a marker situated next to the reference marker used to place the intermediate transfer belt into the stand-by state.

47. An image forming apparatus comprising:

an image forming section configured to form a toner image on an image carrier;

an intermediate transfer body to which the toner image is transferred from said image carrier;

a transferring device configured to transfer the toner image from said intermediate transfer body to a sheet-like recording medium;

a storage device configured to store a frequency of use of each of a plurality of regions of said intermediate transfer body; and a drum configured to select, in accordance with frequencies of use stored in said storage device, a transfer start position on said intermediate transfer body where a transfer of the toner image to said intermediate transfer body should start.

48. An image forming apparatus comprising:

a plurality of image forming sections each including a respective image carrier configured to form a toner image on said respective image carrier, a respective optical writing device configured to write optically a latent image on said respective image carrier, at least two developing devices each configured to develop the latent image with toner of particular color, and switching device configured to select one of said two developing devices;

an intermediate image transfer body to which the toner image is transferred;

a transferring device configured to transfer a composite toner image from said intermediate transfer body to a sheet-like recording medium;

a storage device configured to store a frequency of use of each of a plurality of regions of said intermediate transfer body; and a drum configured to select, in accordance with frequencies of use stored in said storing device, a transfer start position where a transfer of the toner image to said intermediate transfer body should start.

* * * * *